US008408675B2

(12) United States Patent
Hagiwara et al.

(10) Patent No.: US 8,408,675 B2
(45) Date of Patent: Apr. 2, 2013

(54) LIQUID EJECTING HEAD UNIT AND LIQUID EJECTING APPARATUS

(75) Inventors: Hiroyuki Hagiwara, Matsumoto (JP); Keiichi Sato, Sakata (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/330,485

(22) Filed: Dec. 19, 2011

(65) Prior Publication Data

US 2012/0182349 A1 Jul. 19, 2012

(30) Foreign Application Priority Data

Jan. 14, 2011 (JP) ..... 2011-006494

(51) Int. Cl.
*B41J 23/00* (2006.01)

(52) U.S. Cl. ..... 347/37

(58) Field of Classification Search ..... 347/37
See application file for complete search history.

(56) References Cited

U.S. PATENT DOCUMENTS 6,224,709 B1 * 5/2001 Takemoto et al. ..... 156/275.5
2003/0085943 A1 5/2003 Nakamura et al.

FOREIGN PATENT DOCUMENTS

JP 2007-090327 A 4/2007

* cited by examiner

*Primary Examiner* — Lamson Nguyen
(74) *Attorney, Agent, or Firm* — Kilpatrick Townsend & Stockton LLP

(57) ABSTRACT

The head unit includes: a recording head; and a sub-carriage to which the recording head is fixed in a state where spacers are interposed therebetween, wherein each spacer has a spacer main body portion having a base surface which comes into contact with the sub-carriage, and back end-side protrusion portions, reference plane protrusion portions, and leading end-side protrusion portions, which are convex portions that rise from the spacer main body portion to direct toward the flange portion side, to which the spacer is fixed, from the sub-carriage side and which are respectively formed toward a leading end portion of the flange portion in relation to a direction of the nozzle row, at both end portions in a width direction perpendicular to the nozzle row of the recording head, each reference plane protrusion portion has a surface that becomes a reference plane which comes into contact with the flange portion.

14 Claims, 19 Drawing Sheets

LIQUID EJECTING HEAD UNIT AND LIQUID EJECTING APPARATUS

The entire disclosure of Japanese Patent Application No: 2011-006494, filed Jan. 14, 2011 is expressly incorporated by reference herein.

BACKGROUND

1. Technical Field

The present invention relates to a liquid ejecting head unit which is used in a liquid ejecting apparatus such as an ink jet type recording apparatus, and a liquid ejecting apparatus and particularly, to a liquid ejecting head unit in which it is possible to detachably mount a plurality of liquid ejecting heads on a head fixing member, and a liquid ejecting apparatus.

2. Related Art

A liquid ejecting apparatus is an apparatus which is provided with a liquid ejecting head capable of ejecting liquid as liquid droplets and ejects various liquids from the liquid ejecting head. As a representative example of the liquid ejecting apparatus, for example, an image recording apparatus such as an ink jet type recording apparatus (printer) which is provided with an ink jet type recording head (hereinafter referred to as a recording head) and ejects ink in the form of a liquid as ink droplets from nozzles of the recording head, thereby performing recording, can be given. Further, in recent years, the liquid ejecting apparatus has been applied to not only the image recording apparatus, but also various manufacturing apparatuses such as a display manufacturing apparatus. Then, in a recording head for the image recording apparatus, ink in the form of a liquid is ejected, and in a color material ejecting head for the display manufacturing apparatus, solutions of the respective color materials of R (Red), G (Green), and B (Blue) are ejected. Further, in an electrode material ejecting head for an electrode forming apparatus, an electrode material in the form of a liquid is ejected, and in a biological organic matter ejecting head for a chip manufacturing apparatus, a solution of biological organic matter is ejected.

In recent years, as the printer, a printer that adopts a configuration (a multi-head type) in which a structure in which a plurality of recording heads having a nozzle row composed of a plurality of nozzles provided in a row are fixed side by side to a head fixing member such as a sub-carriage is set to be a single head unit has been present. Then, in a configuration in which screw fastening is performed in a state where each recording head is positioned with respect to the sub-carriage, after the positioning and before the screw fastening, temporary fixation of the recording head to the sub-carriage by an adhesive (for example, an instant adhesive) is performed. In this way, when main fixation is performed by the screw fastening, the position of the recording head can be prevented from being shifted by rotation moment at the time of the screw fastening. In the case of adopting such temporary fixation by an adhesive, it becomes difficult to detach the recording head once fixed to the sub-carriage in order to repair or replace it. With respect to such a problem, a configuration in which an intermediary member that is called a spacer is interposed between the recording head and the sub-carriage has also been proposed (for example, JP-A-2007-90327). According to this configuration, by fixing the spacer to the recording head in advance by screw fastening, temporarily fixing the spacer and the sub-carriage to each other by an adhesive, and then performing main fixation of the spacer and the sub-carriage by screw fastening, the recording head once fixed to the sub-carriage can be detached from the spacer and the sub-carriage by releasing the screw fastening between the recording head and the spacer. In this way, mounting and detachment of the recording head for repair, replacement, or the like of the recording head is facilitated.

Incidentally, in the structure as described above, in which the recording head is fixed to the sub-carriage with the spacer interposed therebetween, the recording head has flange portions which respectively protrude to both sides with a head main body interposed therebetween, and is fixed to the sub-carriage in a state where the head main body is fixed to the spacers through the respective flange portions. Here, there is a need to maintain a nozzle face of the recording head at a given height position from the sub-carriage with high precision. However, such a height position is made so as to be ensured by the height position from the sub-carriage of the spacer with which the flange portion comes into contact. Therefore, at both end portions of the spacer in a width direction perpendicular to a nozzle row direction of the recording head, reference plane protrusion portions that are convex portions which rise toward the flange portion from a base surface that comes into contact with the sub-carriage are formed, and the surfaces of the reference plane protrusion portions of both the end portions are used as reference planes for the height position. That is, the reference planes are worked with high precision so as to be at given height positions and the height position of a nozzle row with respect to the sub-carriage is positioned with high precision by fixing the recording head to the spacers with the flange portions brought into contact with the reference planes of both the end portions.

However, in an existing spacer, although it has back end-side protrusion portions that are convex portions of the same sort each integrally formed contiguous to the reference plane protrusion portion, convex portions are not present further on the leading end side than the reference plane protrusion portions. As a result, in a case where the spacer is molded using resin, resin sagging caused by the lack of filling of resin due to the residue of gas at the time of molding occurs in leading end portions of the reference plane protrusion portions. As a result, a function as the reference plane of the reference plane protrusion portion is inhibited. That is, a disadvantage such as being incapable of obtaining a sufficient area for coming into contact with the flange portion, thereby stably holding the flange portion at a given height position, arises. On the other hand, in a case where the reference plane of the reference plane protrusion portion is widely formed in advance in expectation of the resin sagging, uniformly working the precision of the height position with high precision is troublesome. That is, since high-precision adjustment of a metal mold is required and the frequency of a periodic maintenance also increases, it leads to an increase in cost. Further, the size of the spacer becomes large, whereby the sizes of the sub-carriage and a carriage become large, so that an increase in the size of the liquid ejecting apparatus becomes large, resulting in a reduction in a commodity value.

In addition, such a problem is similarly present not only in the ink jet type recording apparatus provided with the recording head which ejects ink, but also in another liquid ejecting head unit adopting a configuration in which a liquid ejecting head is fixed to a head fixing member such as the sub-carriage with an intermediary member such as a spacer interposed therebetween, and a liquid ejecting apparatus which is provided with the liquid ejecting head unit.

SUMMARY

An advantage of some aspects of the invention is that it provides a liquid ejecting head unit in which the structure of an intermediary member which allows a liquid ejecting head to be mounted on a head fixing member with high positional precision in a state where the intermediary member is interposed therebetween is devised, and a liquid ejecting apparatus which is provided with the liquid ejecting head unit.

According to an aspect of the invention, there is provided a liquid ejecting head unit including: a liquid ejecting head having a nozzle formation surface in which a nozzle row that includes a plurality of nozzles ejecting liquid which are provided in a row is formed; and a head fixing member to which the liquid ejecting head is fixed in a state where intermediary members are interposed therebetween, wherein the liquid ejecting head has intermediary member fixing portions to which the intermediary members are fixed and which are respectively provided on both sides with a head main body interposed therebetween, each of the intermediary members has an intermediary member main body portion having a base surface which comes into contact with the head fixing member, and back end-side protrusion portions, reference plane protrusion portions, and leading end-side protrusion portions, which are convex portions that rise from the intermediary member main body portion to direct toward the intermediary member fixing portion side from the head fixing member side and which are respectively formed toward a leading end portion of each intermediary member fixing portion in relation to a direction of the nozzle row, at both end portions in a width direction perpendicular to the nozzle row, each of the reference plane protrusion portions has a surface that becomes a reference plane which comes into contact with the intermediary member fixing portion, thereby defining the height position of the liquid ejecting head with respect to the head fixing member, each of the back end-side protrusion portions is integrally formed contiguous to each of the reference plane protrusion portions on the base end portion side in relation to the direction of the nozzle row such that the height position of the surface thereof becomes equal to or less than the reference plane, and each of the leading end-side protrusion portions is integrally formed contiguous to each the reference plane protrusion portions on the leading end portion side in relation to the direction of the nozzle row such that the height position of the surface thereof becomes equal to or less than the reference plane.

According to this aspect, since not only the back end-side protrusion portions, but also the leading end-side protrusion portions are integrally formed contiguous to the reference plane protrusion portions to continue to the reference plane protrusion portions, even in a case where the intermediary member is molded using resin, resin sagging caused by the lack of filling of resin due to the residue of gas at the time of molding in the reference plane protrusion portions does not occur in the leading end portions of the reference planes of the reference plane protrusion portions. As in the past, in a case where a reference plane protrusion portion has a dead end, the residue of gas is prone to occur at the time of molding. However, in this aspect, this is because the residue of gas in the reference plane protrusion portion can be prevented before it happens.

Accordingly, it is possible to secure a reference plane having a necessary and sufficient area, which is a planar surface maintained at a high-precision height position in the reference plane protrusion portion. Incidentally, in a case where a reference plane is just made wide, working the entire area into a uniform surface with high precision becomes troublesome work. Specifically, the adjustment and the high-frequency periodic maintenance of a high-precision metal mold are required, leading to an increase in cost. On the contrary, according to this aspect, it is possible to fix the liquid ejecting head to the head fixing member in a state where the height position from the head fixing member of the nozzle formation surface of the liquid ejecting head is positioned with high precision through the reference plane having a necessary and sufficient area.

In the above configuration, it is preferable that an inner space surrounded by the back end-side protrusion portions, the reference plane protrusion portions, and the leading end-side protrusion portions be made to be a concave portion which receives a nut.

According to the above configuration, since the leading end-side protrusion portions can also contribute to improvement in the rigidity of the concave portion, the rigidity against a clamping force at the time of nut fastening is improved by a corresponding amount.

In the above configuration, it is preferable that chamfered portions for injection of an adhesive be provided around the base surface of the intermediary member and cutout portions toward the chamfered portion side from the intermediary member fixing portion side be formed in the leading end sides of the leading end-side protrusion portions.

According to the above configuration, when the intermediary member is fixed to the head fixing member by an adhesive, since the adhesive can be filled around the base surface through the chamfered portions, it is possible to easily and accurately perform such adhesive filling work. Here, at the time of adhesive filling work to the chamfered portions, since a state where an obstacle interfering with an adhering tool is not present midway can be created by using the cutout portions, it is possible to accurately and easily perform the filling work.

In the above configuration, it is preferable that tips of ejector pins at the time of injection molding come into contact with the surfaces of the leading end-side protrusion portions.

According to the above configuration, since it is possible to bring the ejector pins into contact with the leading end-side protrusion portions at the time of injection molding of the intermediary member, it is possible to remove gas from the ejector pin portions. Incidentally, since the reference plane protrusion portion requires a high-precision height position, it is not possible to perform degassing by bringing the ejector pins into contact therewith. This is because if the tip of the ejector pin comes into contact with the reference plane, so that the reference plane protrudes at the ejector pin, the precision of the reference plane is lowered. In this manner, in this aspect, there is the effect of making it easier to remove gas in the reference plane protrusion portion from the leading end-side protrusion portion that is continuously contiguous to the reference plane protrusion portion.

In the above configuration, it is preferable to make it a structure in which in each of the intermediary member fixing portions, an intermediary member mounting hole for mounting the intermediary member is provided at a central portion in the width direction and a head-side positioning hole which becomes the reference of positioning with respect to the intermediary member is provided at a position that deviates from the central line in the width direction, and in each of the intermediary members, an intermediary member-side positioning hole which becomes the reference of positioning with respect to the intermediary member fixing portion is provided at a position corresponding to the head-side positioning hole of each of the intermediary member fixing portions, and the intermediary members are fixed to the intermediary member fixing portions on both sides in directions symmetrical to each other in a state where positioning is performed by aligning the intermediary member-side positioning holes with the head-side positioning holes.

According to the above configuration, the intermediary members which are respectively fixed to the intermediary member fixing portions on both sides of the liquid ejecting head can be made to have the same shape. As a result, it is possible to suppress an inclination of the liquid ejecting head positioned on the head fixing member as much as possible. In particular, since in the respective intermediary members, the intermediary member-side positioning holes are provided at a total of two places corresponding to the head-side positioning holes of the intermediary member fixing portions on both sides of the liquid ejecting head, even in a configuration in which the positioning holes are inevitably provided at positions that deviate from the central lines in the width direction in the intermediary member fixing portions from the relationship that the intermediary member mounting holes are provided at central portions of the intermediary member fixing portions after the intermediary member is made as small as possible, the commonalization of the intermediary members on both sides becomes possible. In this way, variations in the shapes and the dimensions of the intermediary members are reduced.

In the above configuration, it is preferable to adopt a configuration in which the width in a direction perpendicular to the nozzle row in the intermediary member is formed narrower than the width in a direction perpendicular to the nozzle row in the liquid ejecting head.

According to the above configuration, since the width in a direction perpendicular to the nozzle row in the intermediary member is formed narrower than the width in a direction perpendicular to the nozzle row in the liquid ejecting head, in a case where a plurality of liquid ejecting heads are disposed side by side on the head fixing member, interference of the intermediary member between adjacent liquid ejecting heads is prevented. Accordingly, it is possible to narrow the pitch between the liquid ejecting heads, so that it can contribute to a reduction in the size of the liquid ejecting head unit.

In the above configuration, it is preferable to adopt a configuration in which the respective head-side positioning holes of the intermediary member fixing portions on both sides of the liquid ejecting head are provided at positions that respectively deviate by the same distance from the central line to one side in a direction perpendicular to the nozzle row.

Further, according to another aspect of the invention, there is provided a liquid ejecting apparatus including: the above liquid ejecting head unit.

According this aspect, since the liquid ejecting apparatus is provided with the liquid ejecting head unit fixed to the head fixing member in a state where the height position from the intermediary member of the nozzle formation surface of the liquid ejecting head is positioned with high precision, it is possible to conform the height positions of nozzle faces to each other with high precision, so that variation in the landing of liquid can be removed. As a result, it can effectively contribute to improvement in printing quality or the like.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a mode for carrying out the invention will be described with reference to the accompanying drawings. In addition, although in the embodiments which are described below, various limitations are given as the preferred specific examples of the invention, unless the description of intent to limit the invention is particularly given in the following explanation, the scope of the invention is not to be limited to these aspects. Further, in the following, an ink jet type recording apparatus (hereinafter referred to as a printer) is taken and described as an example of a liquid ejecting apparatus according to the invention.

Figure 1:
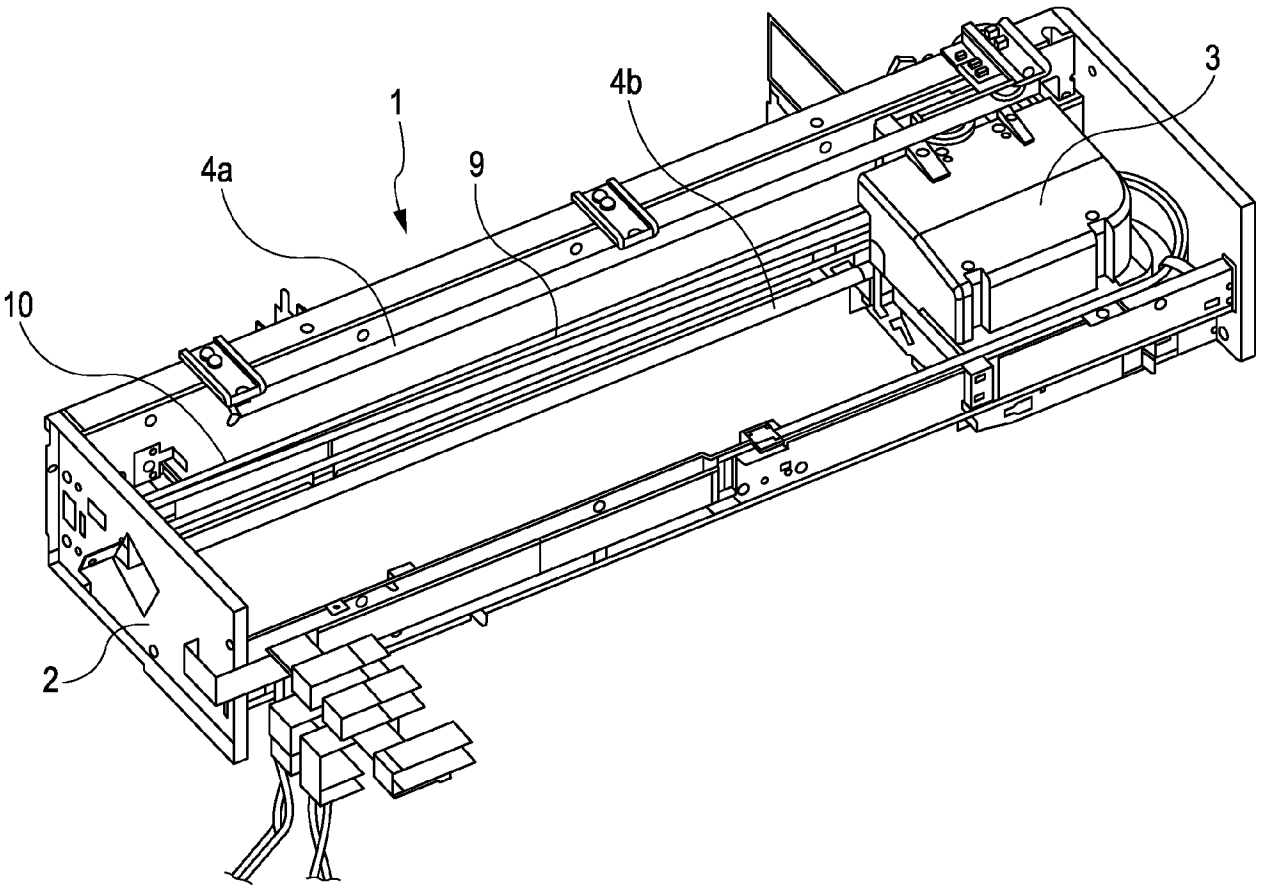
FIG. 1 is a perspective view showing a portion of the internal configuration of a printer.
Figure 2:
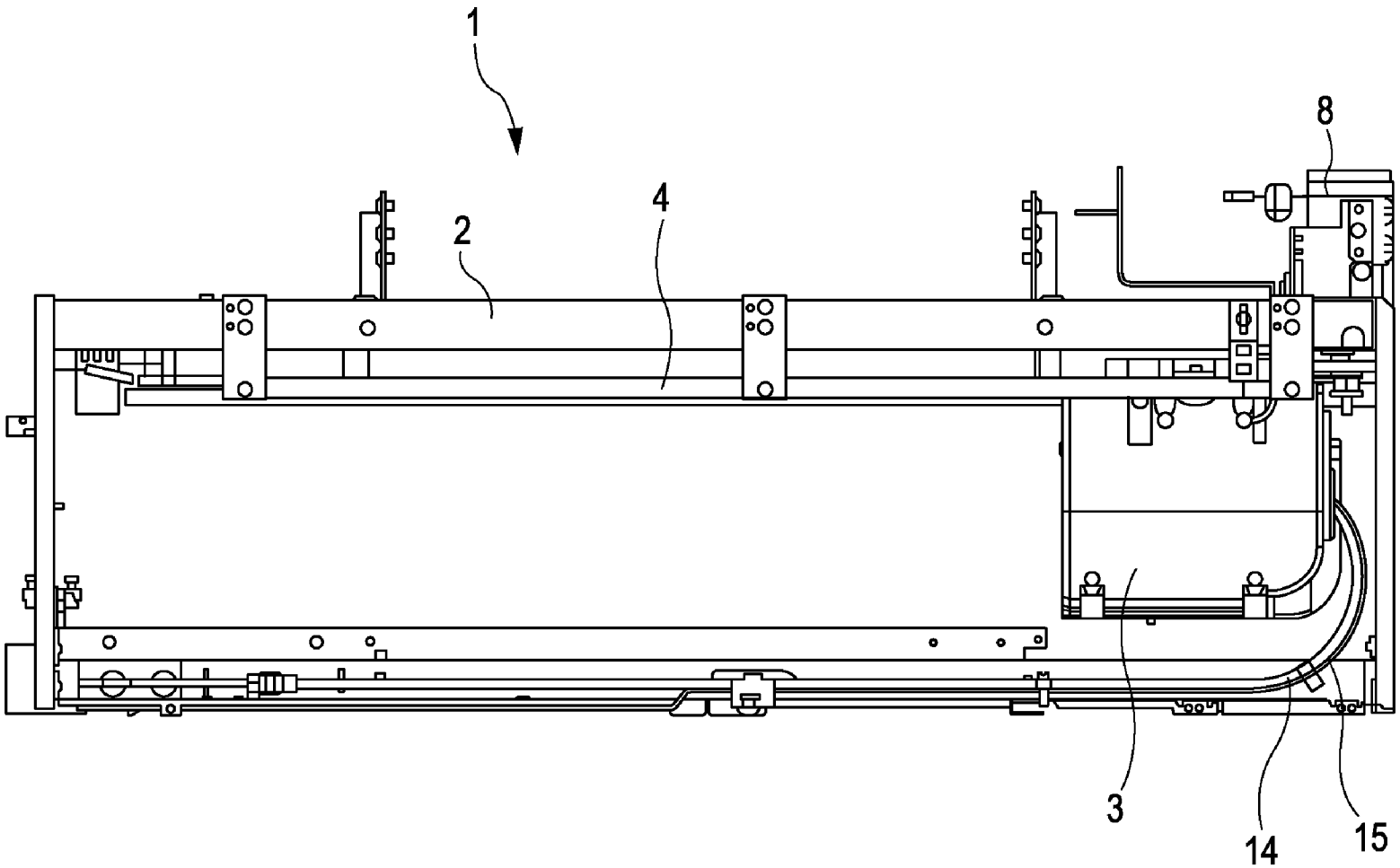
FIG. 2 is a plan view showing a portion of the internal configuration of the printer.

FIG. 1 is a perspective view showing a portion of the internal configuration of a printer 1, and FIG. 2 is a plan view of the printer 1. The printer 1 illustrated ejects ink that is one type of liquid toward a recording medium (a landing target) such as recording paper, cloth, or film. The printer 1 is provided with a carriage 3 (one type of a head unit holding member) mounted in the inside of a frame 2 so as to be able to reciprocate in a main scanning direction that is a direction intersecting a feed direction of the recording medium. On an inner wall of the frame 2 on the back face side of the printer 1, a pair of upper and lower long guide rods 4*a* and 4*b* is mounted in parallel, spaced-apart relationship to each other along the longitudinal direction of the frame 2. The carriage 3 is supported so as to be able to slide with respect to the guide rods 4*a* and 4*b* by making the guide rods 4*a* and 4*b* be fitted into bearing portions 7 (refer to FIG. 4) provided on the back face side thereof.

At one end side (a right end portion in FIG. 2) in the main scanning direction on the back face side of the frame 2, a carriage motor 8 as a driving source for moving the carriage 3 is disposed. A driving shaft of the carriage motor 8 protrudes from the back face side of the frame 2 to the inner face side, and to a leading end portion thereof, a driving pulley (not shown) is connected. The driving pulley is rotated by the driving of the carriage motor 8. Further, at a position on the opposite side (a left end portion in FIG. 2) in the main scanning direction to the driving pulley, an idling pulley (not shown) is provided. A timing belt 9 is spanned across these pulleys. The carriage 3 is connected to the timing belt 9. Then, if the carriage motor 8 is driven, the timing belt 9 rotates in accordance with the rotation of the driving pulley, so that the carriage 3 moves in the main scanning direction along the guide rods 4*a* and 4*b*.

On an inner wall of the back face of the frame 2, a linear scale 10 (an encoder film) is provided to extend parallel to the guide rods 4*a* and 4*b* along the main scanning direction. The linear scale 10 is a strip-shaped (band-shaped) member made of a transparent resin film and is, for example, a member in which a plurality of opaque stripes traversing a strip width direction are printed on the surface of a transparent base film. The respective stripes have the same width and are formed at constant pitches in a strip length direction. Further, on the back face side of the carriage 3, a linear encoder (not shown) for optically reading the stripes of the linear scale 10 is provided. The linear encoder is one type of a position information output section and outputs an encoder pulse according to a scanning position of the carriage 3 as position information in the main scanning direction. In this way, a control section (not shown) of the printer can control a recording operation on the recording medium by a head unit 17 while recognizing the scanning position of the carriage 3 on the basis of the encoder pulse. Then, the printer 1 is configured so as to be able to perform so-called bi-directional recording processing of recording characters, an image, or the like on recording paper bi-directionally at both the time of forward movement in which the carriage 3 moves from a home position on one end side in the main scanning direction toward an end portion (a full position) on the opposite side and the time of return movement in which the carriage 3 returns from the full position to the home position side.

As shown in FIG. 2, an ink supply tube 14 for supplying ink of each color to each recording head 18 (refer to FIG. 5) of the head unit 17 (refer to FIG. 3) and a signal cable 15 for supplying a signal such as a driving signal are connected to the carriage 3. In addition, in the printer 1, although it is not shown in the drawings, a cartridge mounting section on which an ink cartridge (a liquid supply source) with ink stored therein is detachably mounted, a transport section which transports recording paper, a capping section which performs capping of a nozzle formation surface 53 (refer to FIG. 12) of the recording head 18 in a standby state, and the like are provided.

Figure 3:
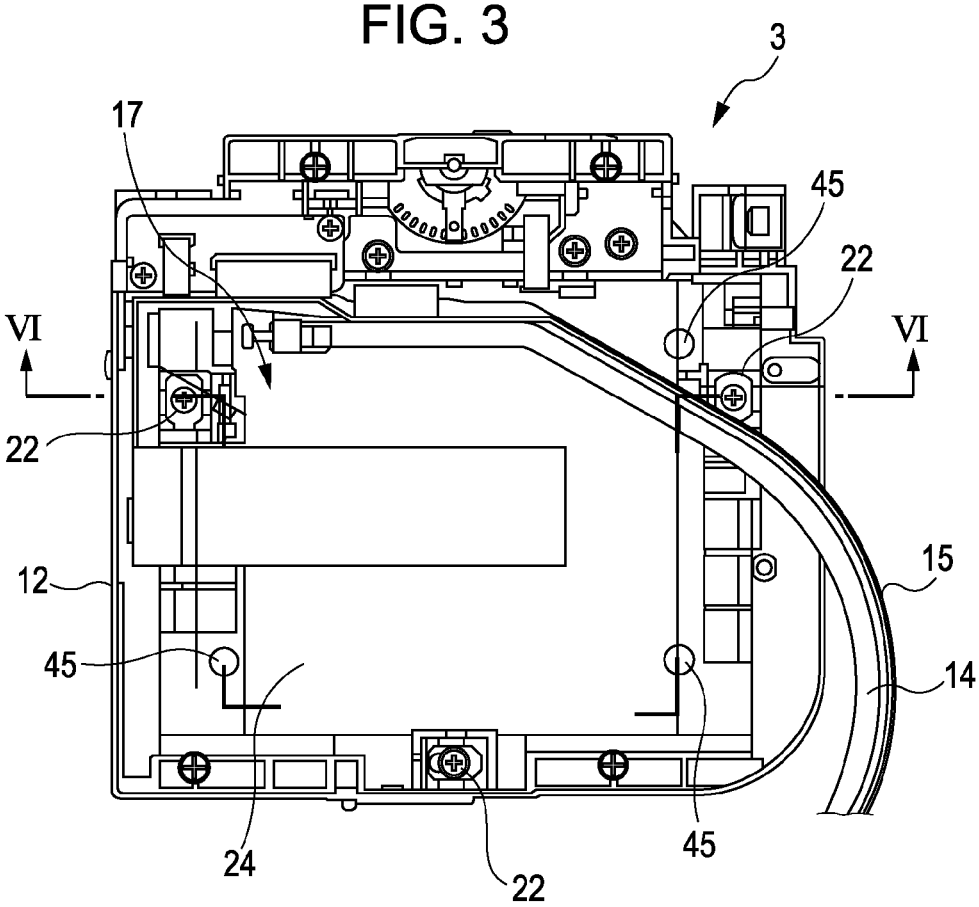
FIG. 3 is a top view of a carriage.
Figure 4:
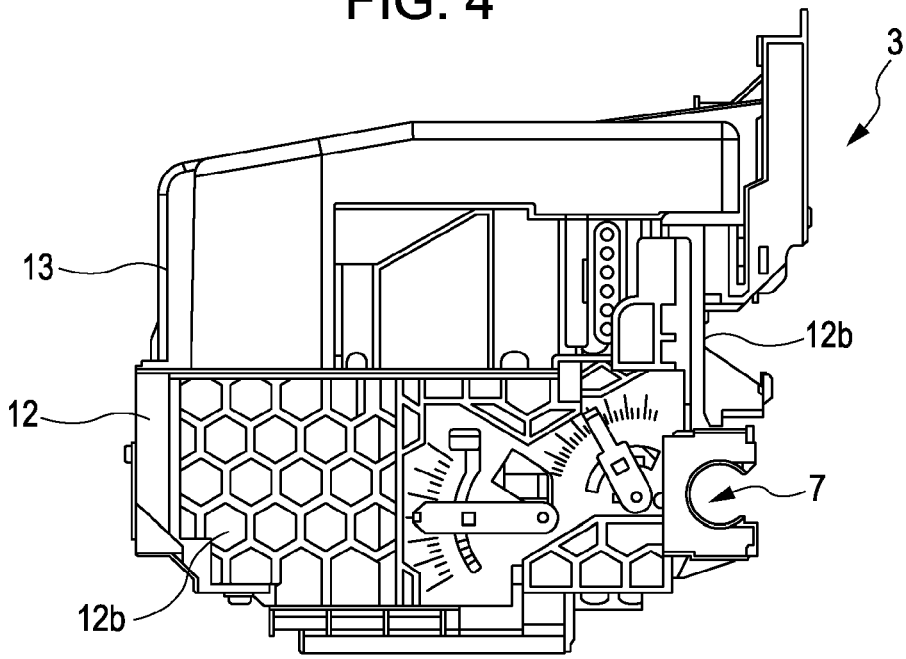
FIG. 4 is a right side view of the carriage.
Figure 5:
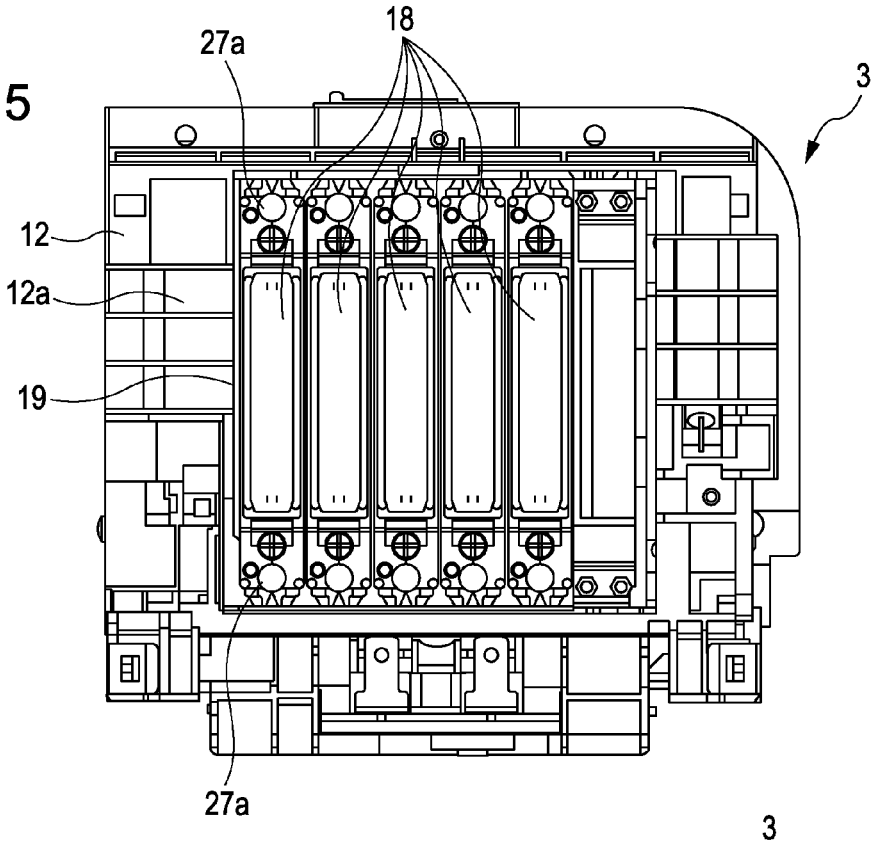
FIG. 5 is a bottom view of the carriage.
Figure 6:
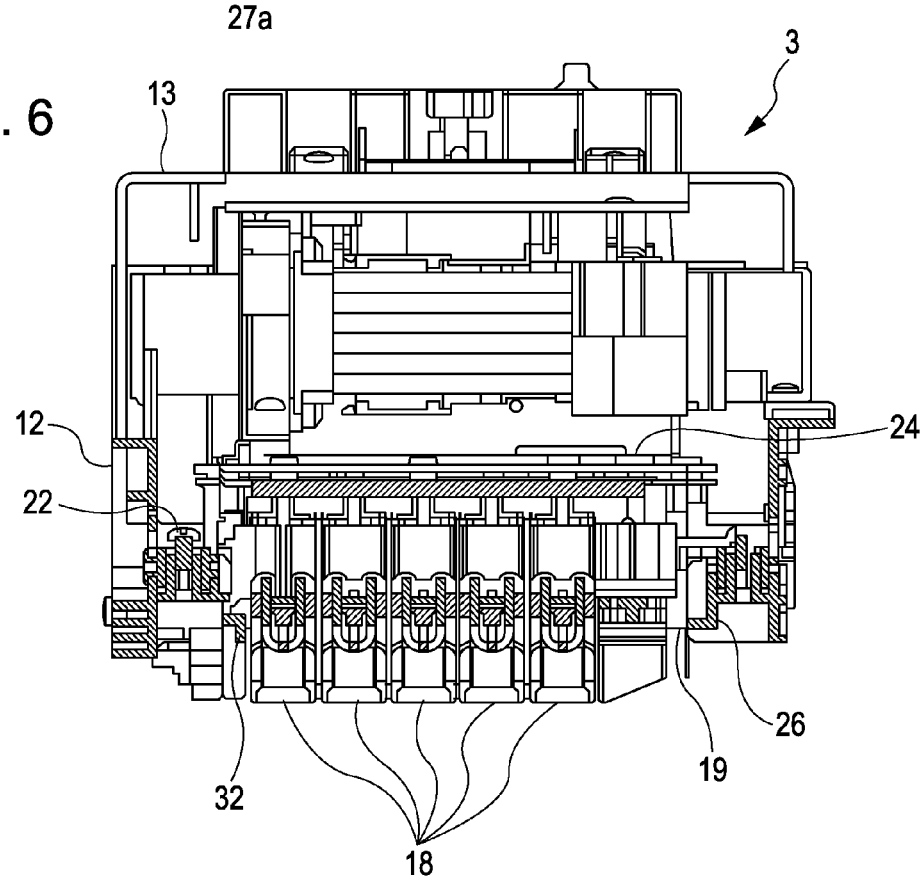
FIG. 6 is a cross-sectional view taken along line VI-VI in FIG. 3.

FIG. 3 is a plan view (top view) of the carriage 3, FIG. 4 is a right side view of the carriage 3, and FIG. 5 is a bottom (lower face) view of the carriage 3. Further, FIG. 6 is a cross-sectional view taken along line VI-VI in FIG. 3. In addition, FIG. 3 shows a state where a carriage cover 13 is removed. The carriage 3 is a hollow box-shaped member that is constituted by a carriage main body 12 in which the head unit 17 (one type of a liquid ejecting head unit in the invention), which will be described later, is mounted in the inside thereof and the carriage cover 13 which blocks an upper opening of the carriage main body 12, and that can be divided up and down. The carriage main body 12 is constituted by an approximately rectangular bottom plate portion 12*a* and side wall portions 12*b* which respectively stand upward from four outer peripheral edges of the bottom plate portion 12*a*, and accommodates the head unit 17 in a space surrounded by the bottom plate portion 12*a* and the side wall portions 12*b*. In the bottom plate portion 12*a*, a bottom opening 19 for exposing the nozzle formation surface 53 of each recording head 18 of the accommodated head unit 17 is opened. Then, in a state where the head unit 17 is accommodated in the carriage main body 12, the nozzle formation surface 53 (refer to FIG. 12) of each recording head 18 protrudes from the bottom opening 19 of the bottom plate portion 12*a* further to a lower side (the recording medium side at the time of a recording operation) than the bottom of the carriage main body 12.

Figure 7A:
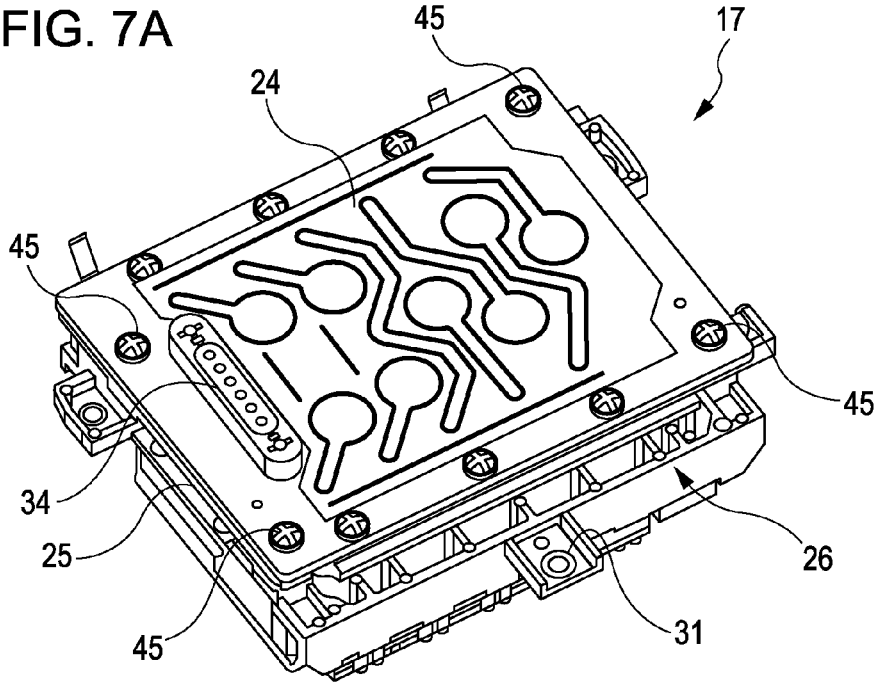
FIGS. 7A and 7B are perspective views of a head unit.
Figure 7B:
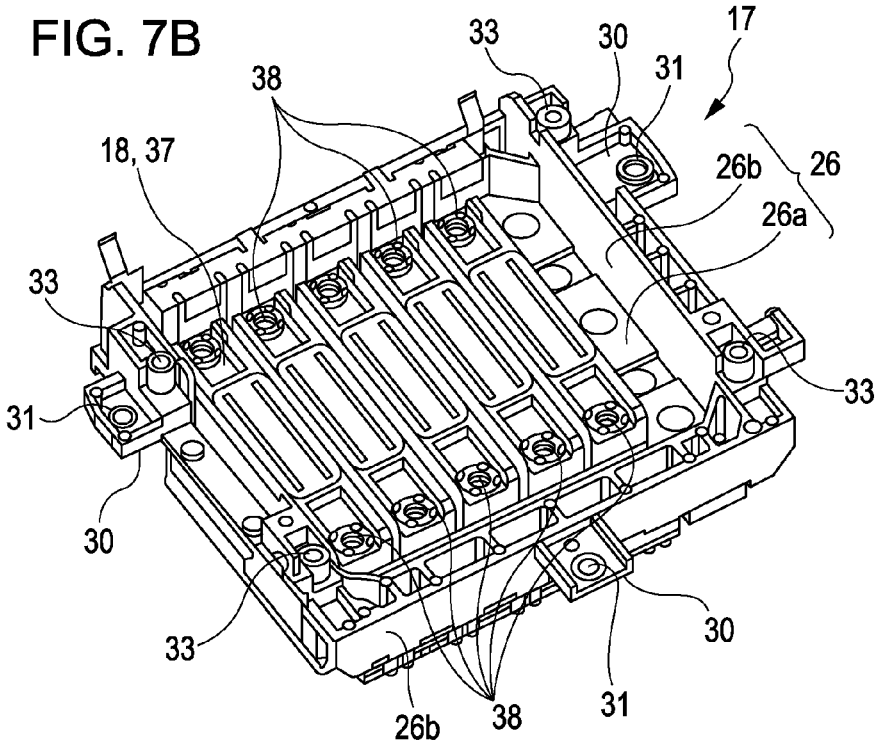
Figure 8:
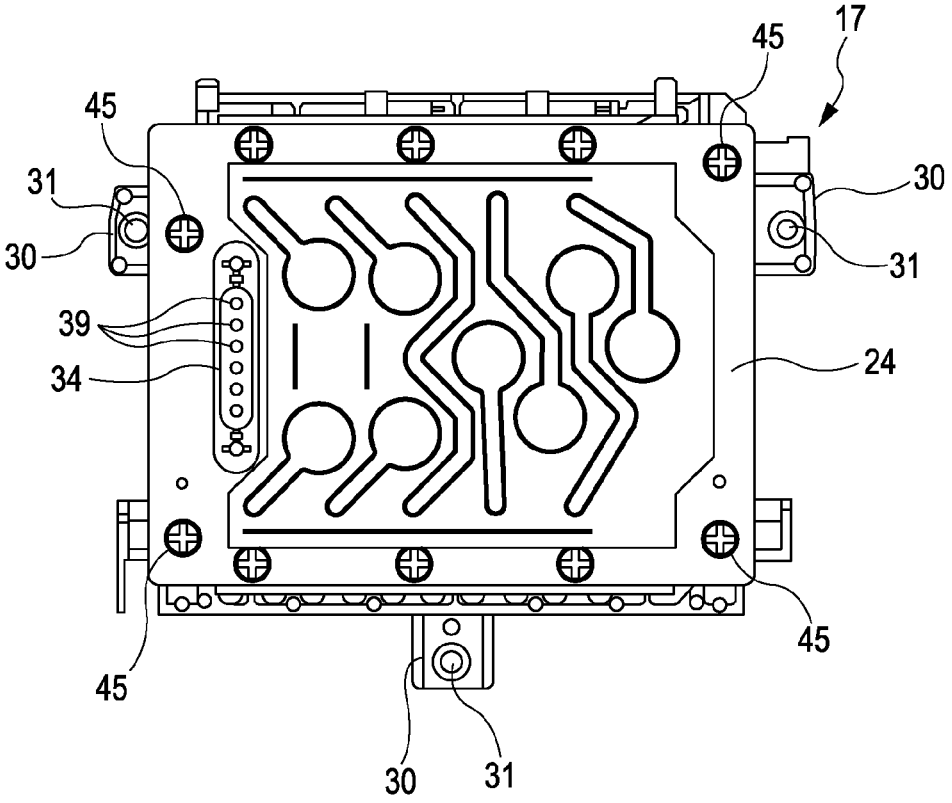
FIG. 8 is a top view of the head unit.
Figure 9:
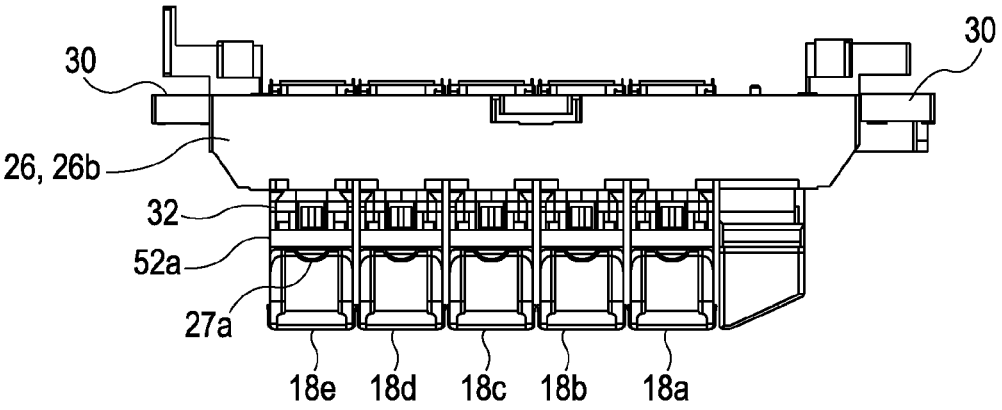
FIG. 9 is a front view of the head unit.

FIGS. 7A and 7B are perspective views of the head unit 17, wherein FIG. 7A shows a state where a flow path member 24 is mounted and FIG. 7B shows a state where the flow path member 24 is removed. Further, FIG. 8 is a top view of the head unit 17, FIG. 9 is a front view of the head unit 17 (a state where the flow path member 24 is removed), FIG. 10 is a bottom view of the head unit 17, and FIG. 11 is a perspective view of the lower face side of the head unit 17.

The head unit 17 is a thing in which a plurality of recording heads 18 and the like are unitized, and is provided with a sub-carriage 26 (one type of a head fixing member in the invention) on which the recording heads 18 are mounted, and the flow path member 24. The sub-carriage 26 is formed into the form of a hollow box having an opened upper face by a plate-like base portion 26*a* to which the recording heads 18 are fixed and standing wall portions 26*b* which respectively stand upward from four outer peripheral edges of the base portion 26*a*. A space surrounded by the base portion 26*a* and the four standing wall portions 26*b* functions as an accommodating portion which accommodates at least a portion (mainly, a sub-tank 37) of the recording head 18. The sub-carriage 26 of this embodiment is made of metal, for example, aluminum and has rigidity increased compared to the carriage main body 12 or the carriage cover 13. In addition, as for a material of the sub-carriage 26, it is not limited to metal and it is also possible to adopt a synthetic resin.

In an approximately central portion of the base portion 26*a* of the sub-carriage 26, a head insertion opening 28 (refer to FIG. 10) into which a plurality of recording heads 18 can be inserted (that is, a single head insertion opening 28 common to the respective recording heads 18) is opened. Therefore, the base portion 26*a* is made to be a picture frame-shaped frame body composed of four side portions. In the lower surface of the base portion 26*a*, a locking hole 29 (refer to FIG. 24) is opened corresponding to a mounting position of each recording head 18. In this embodiment, the locking holes 29 are provided at a total of four places, two for each side, corresponding to insertion holes for sub-carriage 69 (refer to FIG. 24) of a spacer 32, which will be described later, at side portions on both sides in a direction (a direction perpendicular to a head row disposition direction) corresponding to a nozzle row direction with the head insertion opening 28 interposed therebetween, with respect to a mounting position of a single recording head 18.

Figure 10:
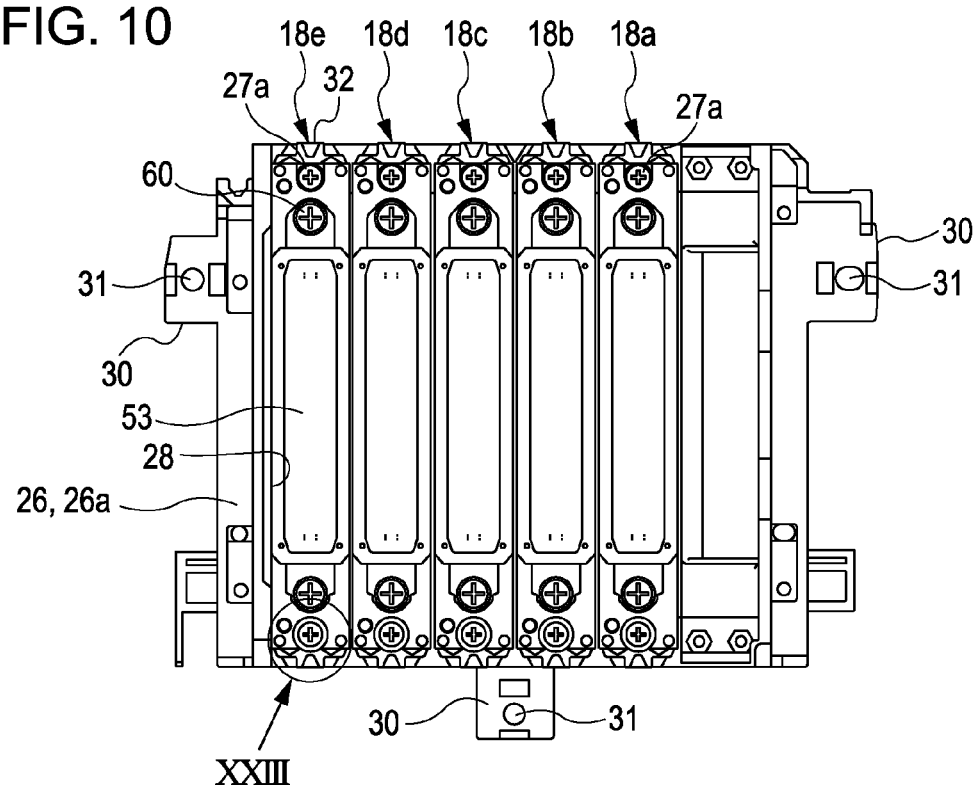
FIG. 10 is a bottom view of the head unit.
Figure 11:
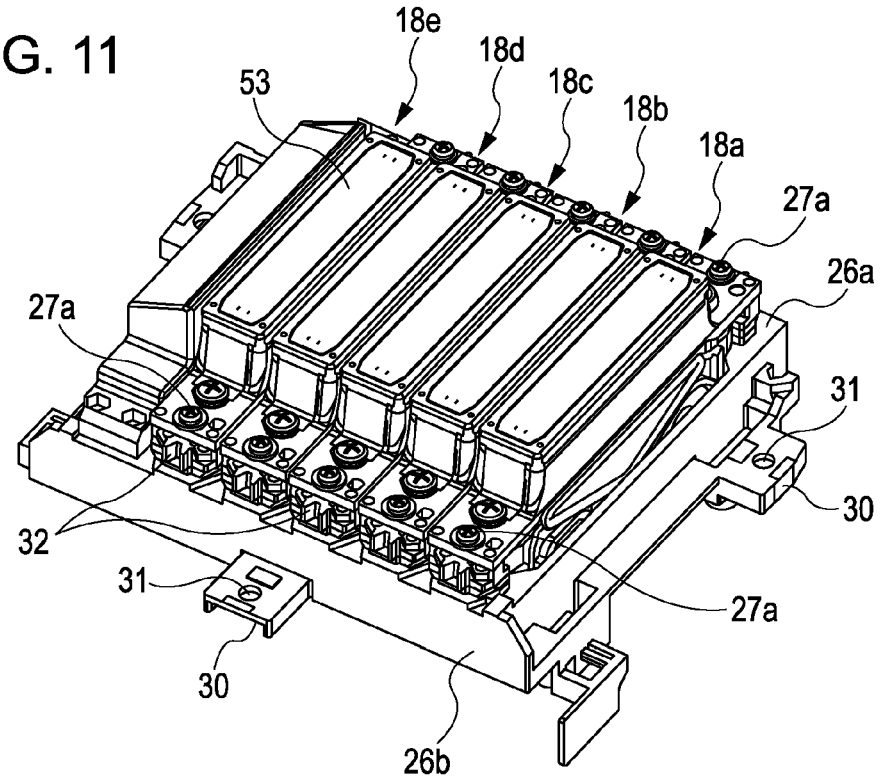
FIG. 11 is a perspective view of the lower face side of the head unit.

In this embodiment, as shown in FIG. 10, a total of five recording heads 18, a first recording head 18*a*, a second recording head 18*b*, a third recording head 18*c*, a fourth recording head 18*d*, and a fifth recording head 18*e*, are accommodated in an accommodating portion by inserting the sub-tank 37, which will be described later, into the head insertion opening 28 from below and respectively fixed to the base portion 26*a* side by side in a direction perpendicular to a nozzle row, in a state where the spacers 32 are interposed between each recording head 18 and the base portion 26*a*.

As shown in FIGS. 7A, 7B, 8, or the like, at three standing wall portions among the four standing wall portions 26*b* of the sub-carriage 26, flange portions 30 are provided to protrude laterally. In each flange portions 30, an insertion hole 31 is opened corresponding to each of mounting threaded holes (not shown) of three places, which are opened at the mounting position of the head unit 17 of the bottom plate portion 12*a* of the carriage main body 12. Then, the head unit 17 is accommodated in and fixed to the inside of the carriage main body 12 by locking head unit fixing screws 22 into the mounting threaded holes through the insertion holes 31 in a state where a corresponding insertion hole 31 is aligned in position with each mounting threaded hole of the bottom plate portion 12*a* of the carriage main body 12. Further, in the upper end surfaces of the four standing wall portions 26*b* of the sub-carriage 26, fixing threaded holes 33 for fixing the flow path member 24 are provided at a total of four places.

The flow path member 24 is a box-shaped member which is thin in an up-and-down direction, and is made of a synthetic resin, for example. In the inside of the flow path member 24, ink distribution flow paths (not shown) for the respective colors respectively corresponding to flow path connection portions 38 of the sub-tanks 37 (described later) of the respective recording heads 18 are partitioned and formed. On the upper surface (the surface on the opposite side to the surface on the side which is fixed to the sub-carriage 26) of the flow path member 24, a tube connection section 34 is provided. As shown in FIG. 8, in the inside of the tube connection section 34, a plurality of introduction ports 39 corresponding to ink of the respective colors are provided. Each introduction port 39 communicates with the ink distribution flow path for a corresponding color. Then, if the above-mentioned ink supply tube 14 is connected to the tube connection section 34, an ink supply path for each color in the ink supply tube 14 and a corresponding introduction port 39 communicate with each other in a liquid-tight state. In this way, ink of each color sent from the ink cartridge side through the ink supply tube 14 is introduced into each ink distribution flow path in the flow path member 24 through the introduction port 39. Further, at positions corresponding to the flow path connection portions 38 of the sub-tanks 37 of the respective recording heads 18 in the lower surface of the flow path member 24, connection flow paths (not shown) are provided. Each connection flow path is configured so as to be inserted into the flow path connection portion 38 of the sub-tank 37 of each recording head 18 and connected thereto in a liquid-tight state. Further, at four corners of the flow path member 24, flow path insertion holes (not shown) corresponding to the fixing threaded holes 33 of the sub-carriage 26 are respectively formed in a state where they penetrate the flow path member 24 in a plate thickness direction. When the flow path member 24 is fixed to the sub-carriage 26, flow path locking screws 45 are locked to (thread-engaged with) the fixing threaded holes 33 through the flow path insertion holes. Then, ink passed through the ink distribution flow path in the inside of the flow path member 24 is supplied to the sub-tank 37 of each recording head 18 through the connection flow path and the flow path connection portion 38.

Figure 12:
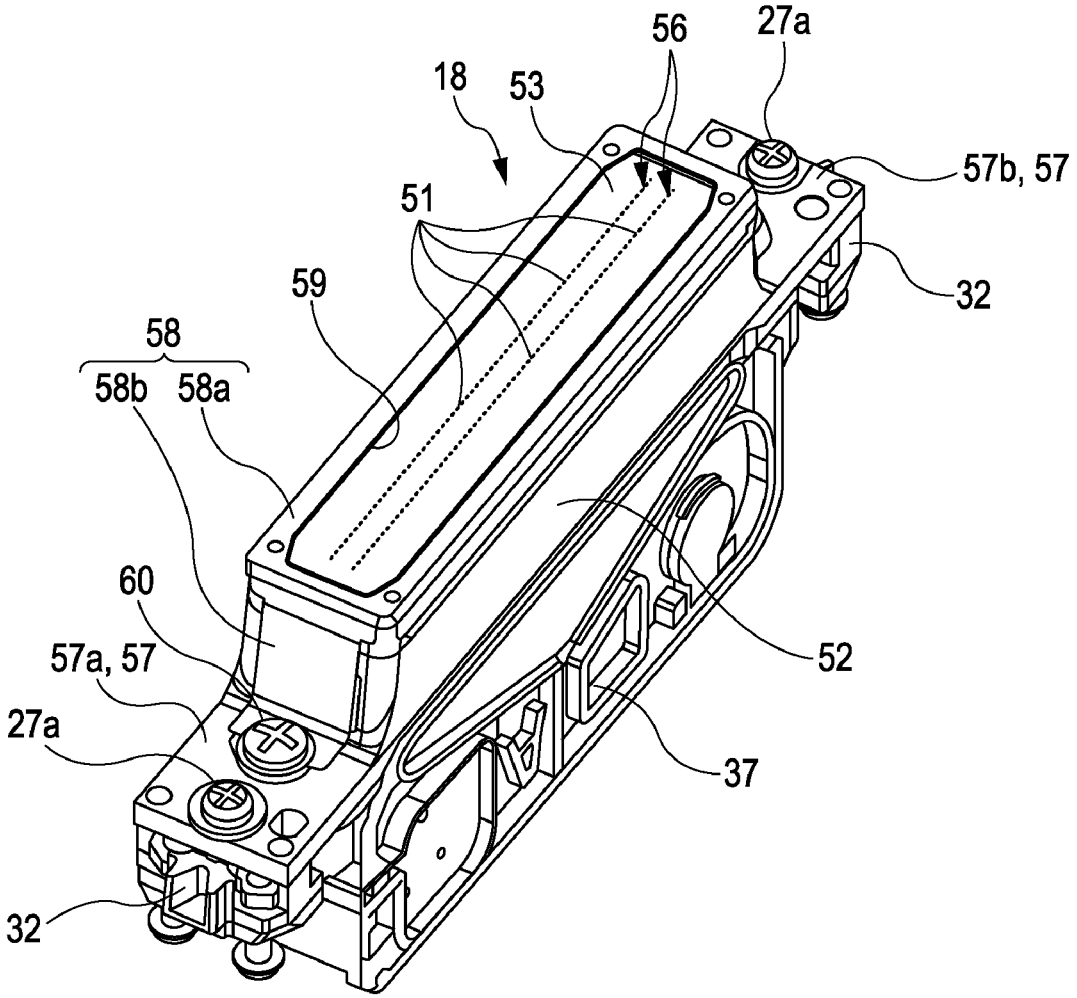
FIG. 12 is a perspective view describing the configuration of a recording head.
Figure 13A:
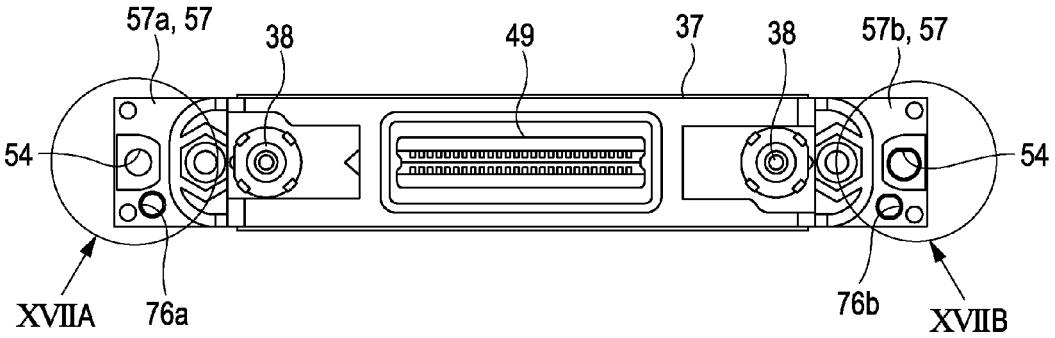
FIGS. 13A and 13B are top views describing the configuration of the recording head.
Figure 13B:
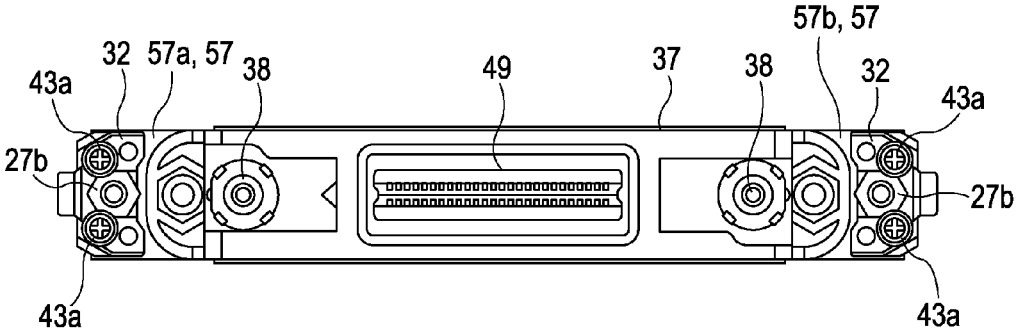
Figure 14A:
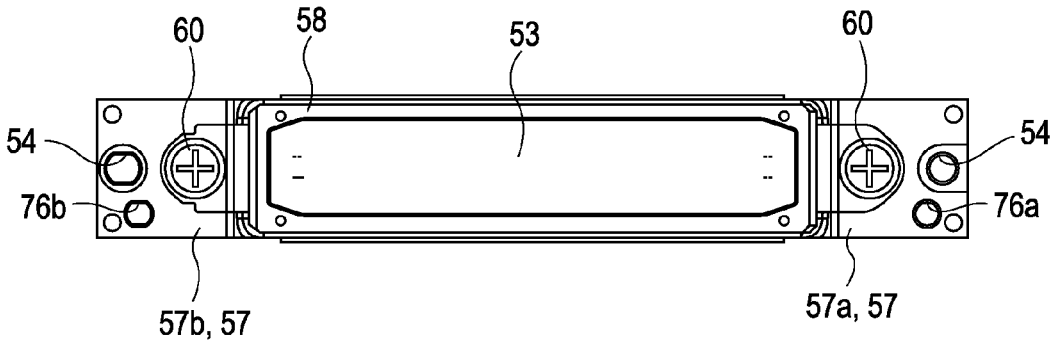
FIGS. 14A and 14B are bottom views describing the configuration of the recording head.
Figure 14B:
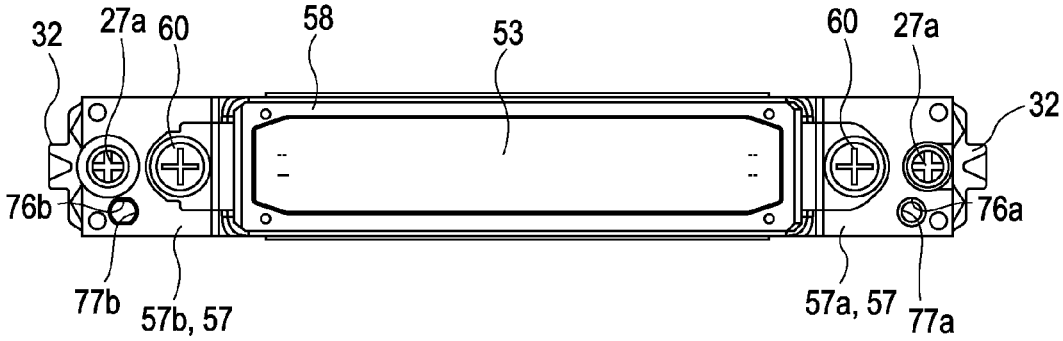
Figure 15A:
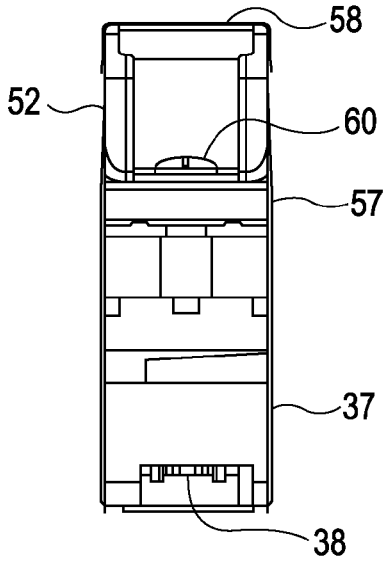
FIGS. 15A and 15B are front views describing the configuration of the recording head.
Figure 15B:
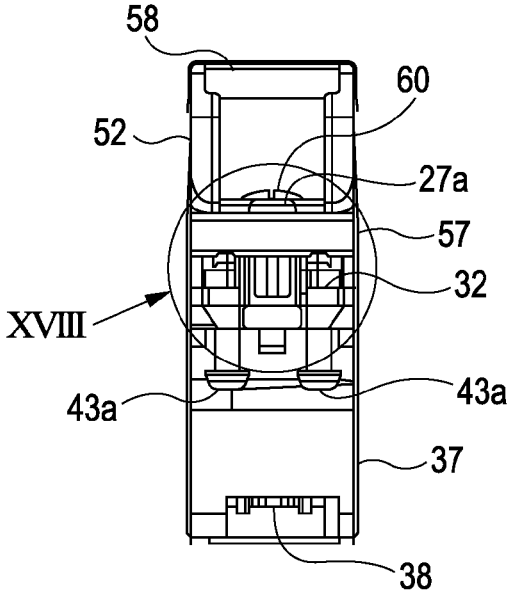
Figure 16A:
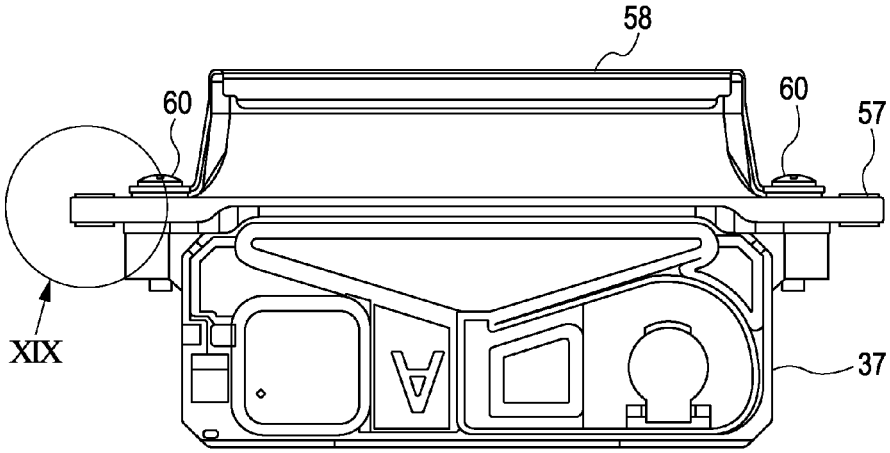
FIGS. 16A and 16B are right side views describing the configuration of the recording head.
Figure 16B:
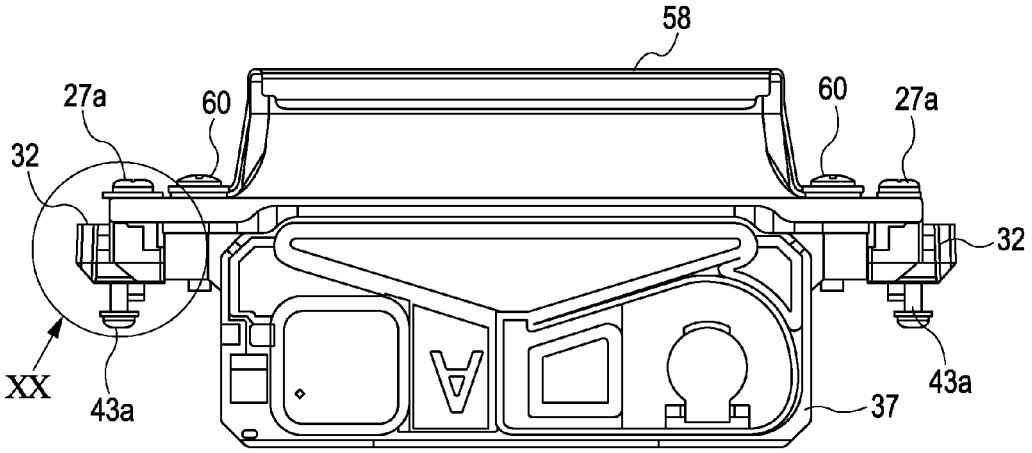

FIG. 12 is a perspective view describing the configuration of the recording head 18 (one type of a liquid ejecting head). FIGS. 13A and 13B are top views of the recording head 18, wherein FIG. 13A shows a state where the spacers 32 are not mounted and FIG. 13B shows a state where the spacers 32 are mounted. FIGS. 14A and 14B are bottom views of the recording head 18, wherein FIG. 14A shows a state where the spacers 32 are not mounted and FIG. 14B shows a state where the spacers 32 are mounted. FIGS. 15A and 15B are front views of the recording head 18, wherein FIG. 15A shows a state where the spacers 32 are not mounted and FIG. 15B shows a state where the spacers 32 are mounted. FIGS. 16A and 16B are right side views of the recording head 18, wherein FIG. 16A shows a state where the spacers 32 are not mounted and FIG. 16B shows a state where the spacers 32 are mounted.

Figure 17A:
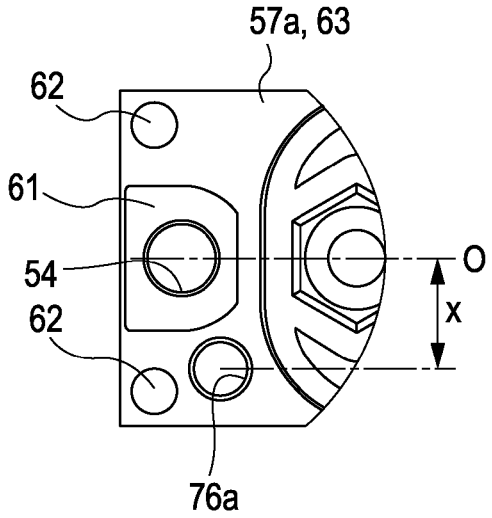
FIG. 17A is an enlarged view of an area XVIIA in FIG. 13A
Figure 17B:
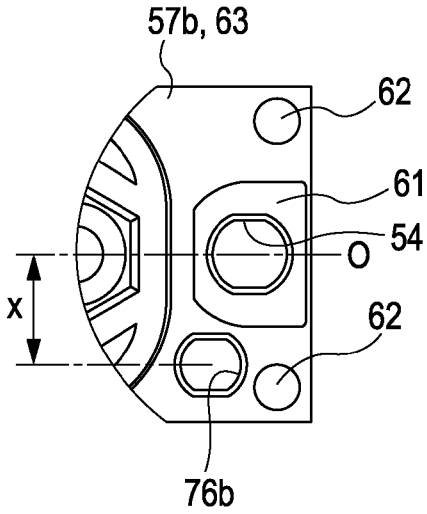
FIG. 17B is an enlarged view of an area XVIIB in FIG. 13A.
Figure 18:
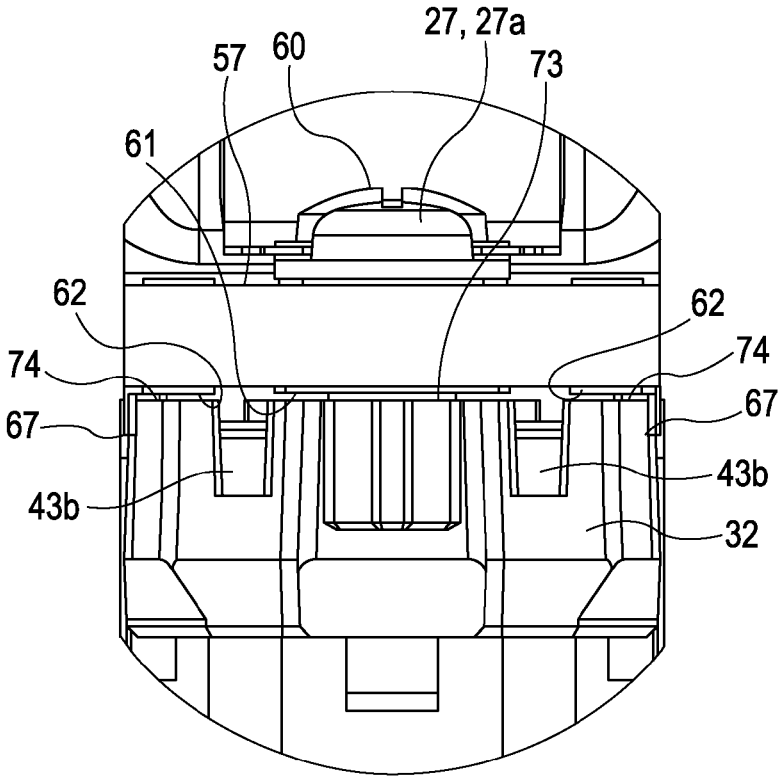
FIG. 18 is an enlarged view of an area XVIII in FIG. 15B.
Figure 19:
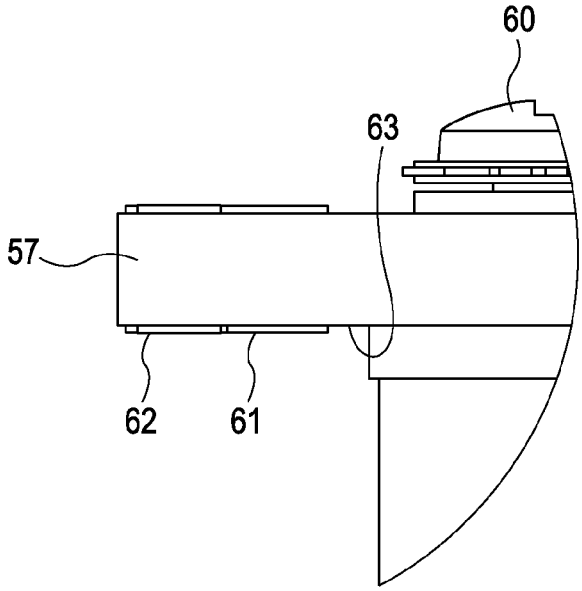
FIG. 19 is an enlarged view of an area XIX in FIG. 16A.
Figure 20:
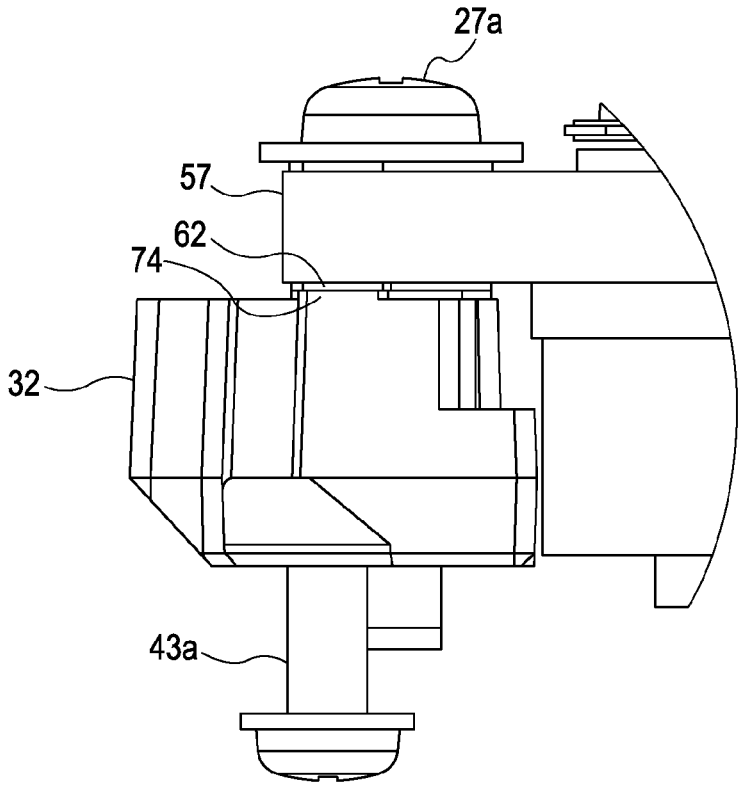
FIG. 20 is an enlarged view of an area XX in FIG. 16B.

Further, FIG. 17A is an enlarged view of an area XVIIA in FIG. 13A, and FIG. 17B is an enlarged view of an area XVIIB in FIG. 13A. FIG. 18 is an enlarged view of an area XVIII in FIG. 15B, and FIG. 19 is an enlarged view of an area XIX in FIG. 16A. Further, FIG. 20 is an enlarged view of an area XX in FIG. 16B. In addition, since a basic structure or the like is common in the respective recording heads 18, one of the five recording heads 18 which are mounted on the sub-carriage 26 is shown as a representative.

The recording head 18 is provided, in a head case 52, with a flow path unit (not shown) which forms an ink flow path that includes a pressure chamber which communicates with a nozzle 51, or a pressure generation section (not shown) such as a piezoelectric vibrator or a heater element, which generates a pressure fluctuation in ink in the pressure chamber. The recording head 18 in this embodiment is formed into a shape which is long in a nozzle row direction in a plan view and on the other hand, short in a width direction perpendicular to a nozzle row. Then, the recording head 18 is configured so as to perform a recording operation in which ink is ejected from the nozzle 51 by driving the pressure generation section by application of a driving signal from the control section side of the printer 1 to the pressure generation section, thereby being landed at the recording medium such as recording paper. A plurality of nozzles 51 which eject ink are provided in a row in the nozzle formation surface 53 of each recording head 18, so that a nozzle row 56 (a nozzle group) is constituted, and the nozzle rows 56 are formed side by side in two rows in a direction perpendicular to the nozzle row. One nozzle row 56 is composed of 360 nozzles provided at a pitch of 360 dpi, for example.

The head case 52 is a hollow box-shaped member and is a portion of a head main body in the invention. The flow path unit is fixed to the leading end side of the head case 52 in a state where the nozzle formation surface 53 is exposed. Further, the pressure generation section or the like is accommodated in an accommodating cavity portion formed in the inside of the head case 52, and on the base end surface side (the top surface side) on the opposite side to a leading end surface, the sub-tank 37 for supplying ink to the flow path unit side is mounted. Further, flange portions 57 (each equivalent to an intermediary member fixing portion in the invention) protruding laterally are respectively formed on both sides in the nozzle row direction on the top surface side of the head case 52. In each flange portions 57, as shown in FIGS. 17A and 17B, a spacer mounting hole 54 (equivalent to an intermediary member mounting hole in the invention) is opened corresponding to an insertion hole for head 68 (refer to FIGS. 21A to 21E) of the spacer 32. When the spacers 32 are respectively mounted on the flange portions 57 on both sides, a shaft portion of a spacer fixing bolt 27*a* is inserted into each spacer mounting hole 54.

The spacer mounting hole 54 is formed in the central portion in a flange width direction that is a direction (an arrangement direction of fastening places to the spacers 32 or a direction perpendicular to the nozzle row) perpendicular to an arrangement direction of the flange portions 57 on both sides, in the flange portion 57, in a state where it penetrates the flange portion 57 in the thickness direction. The spacer mounting hole 54 on one side (the left side in FIG. 13A) of the spacer mounting holes 54 of the flange portions 57 on both sides is a through-hole having a circular hole shape in a plan view, as shown in FIG. 17A, and the inner diameter thereof is set to be slightly larger than the outer diameter of the shaft portion of the spacer fixing bolt 27*a*. Accordingly, the spacer mounting hole 54 on one side is configured such that the shaft portion of the spacer fixing bolt 27*a* can be smoothly inserted and it is difficult for rattling to occur between the two. On the other hand, the spacer mounting hole 54 on the other side (the right side in FIG. 13A) is made to be a long hole which is long in an arrangement direction of the spacer mounting holes 54 (the nozzle row direction) in a plan view, as shown in FIG. 17B. The inner diameter (long diameter) in the mounting hole arrangement direction of the spacer mounting hole 54 on the other side is set to be larger than the outer diameter of the shaft portion of the spacer fixing bolt 27*a* and the inner diameter (short diameter) in the flange width direction perpendicular to the mounting hole arrangement direction is made to correspond with the inner diameter of the spacer mounting hole 54 on one side. In this manner, by setting one of the spacer mounting holes 54 of the flange portions 57 on both sides to be a circular hole and the other to be a long hole, when the respective spacers 32 respectively fixed to both the flange portions 57 are screw-fastened to head mounting portions of the sub-carriage 26, an error between the distance between the locking holes 29 on the sub-carriage 26 side and the distance between the spacer mounting holes 54 is allowed within the range of the long diameter of the long hole.

An opening peripheral portion 61 of each spacer mounting hole 54 protrudes further to the spacer 32 side in a mounted state than a spacer fixing surface 63 (an intermediary member fixing surface) of the flange portion 57. The opening peripheral portion 61 is a bank-shaped protrusion formed in a state of surrounding an opening of the spacer mounting hole 54. Further, convex contact portions 62 each having a circular shape in a plan view are respectively formed on both outer sides in the flange width direction than the spacer mounting hole 54 in the spacer fixing surface 63 of the flange portion 57. In this embodiment, the convex contact portions 62 are respectively provided at outer corner portions of each of the flange portions 57 on both sides. Each of the convex contact portions 62 protrudes further to the spacer 32 side in the mounted state than the spacer fixing surface 63 of the flange portion 57.

Further, in a flange portion 57*a* (the left side in FIG. 13A) on one side of the spacer fixing surfaces 63 of the flange portions 57 on both sides, a circular hole 76*a* (equivalent to a head-side positioning hole in the invention) which becomes the reference of positioning with respect to the spacer 32 is opened corresponding to a positioning hole 77*a* of the spacer 32, which will be described later. Similarly, in a flange portion 57*b* (the right side in FIG. 13A) on the other side, a long hole 76*b* (equivalent to a head-side positioning hole in the invention) which becomes the reference of positioning with respect to the spacer 32 is opened corresponding to a positioning hole 77*b* of the spacer 32.

The circular hole 76*a* is provided in a state in which it penetrates the flange portion 57*a* in the thickness direction, at a position which does not interfere with the spacer mounting hole 54, the opening peripheral portion 61, and the convex contact portion 62 in the flange portion 57*a* and deviates further to one side (the lower side in the drawing) than the central line (shown by symbol ○ in the drawing) in the flange width direction, as shown in FIG. 17A. The circular hole 76*a* is a through-hole having an opening of a circular hole shape in a plan view and the inner diameter thereof is set to be slightly larger than the outer diameter of a positioning pin 80*a* of a positioning jig 79 (refer to FIG. 25) which will be described later. Further, the long hole 76*b* is provided in a state where it penetrates the flange portion 57*b* in the thickness direction, at a position which does not interfere with the spacer mounting hole 54, the opening peripheral portion 61, and the convex contact portion 62 and deviates further to one side (the lower side in the drawing) than the central line (shown by symbol ○ in the drawing) in the flange width direction, as shown in FIG. 17B. The long hole 76*b* is a through-hole having an opening of an oblong shape which is long in a positioning hole arrangement direction in a plan view. The inner diameter (long diameter) in the positioning hole arrangement direction of the long hole 76*b* is set to be sufficiently larger than the outer diameter of a positioning pin 80*b* of the positioning jig 79, and the inner diameter (short diameter) in the flange width direction of the long hole 76*b* is made to correspond with the inner diameter of the circular hole 76*a*. In addition, the positioning of the spacer 32 with respect to the flange portion 57 by using the positioning jig 79 will be described later.

In this embodiment, the circular hole 76*a* and the long hole 76*b* are provided at positions which respectively deviate by the same distance (shown by symbol x in the drawing) from the central line ○ in the flange width direction to one side (the lower side in the drawing) in the flange width direction. That is, the distance from the central line ○ in the flange width direction to the circular hole 76*a* and the distance from the central line ○ in the flange width direction to the long hole 76*b* are set to become equal to each other.

On the leading end surface side of the head case 52, a cover member 58 which protects the flow path unit or a peripheral portion of the nozzle formation surface 53 from contact of recording paper or the like is mounted. The cover member 58 is made of a thin metal plate having conductivity, such as stainless steel. The cover member 58 in this embodiment is schematically constituted by a picture frame-shaped frame portion 58*a* having an opening window portion 59 opened in a central portion, and side plate portions 58*b* respectively extending from edge portions on both sides in the nozzle row direction of the frame portion 58*a* along the side surfaces of the head case 52 in a state where it is mounted on the head case 52. A leading end portion of each side plate portion 58*b* is bent outward so as to turn into a form following the flange portion 57 and screw-fastened to the flange portion 57 by a cover locking screw 60. The cover member 58 has also a function to adjust the nozzle formation surface 53 to a ground potential, in addition to a function to protect the flow path unit or the peripheral portion of the nozzle formation surface 53.

The sub-tank 37 is a member which introduces ink from the flow path member 24 to the pressure chamber side of the recording head 18. The sub-tank 37 has a self-sealing function to open and close a valve depending on a pressure fluctuation in the inside, thereby controlling the introduction of ink to the pressure chamber side. The flow path connection portions 38 to which the connection flow paths of the flow path member 24 are connected are provided at both end portions in the nozzle row direction in the back end surface (top surface) of the sub-tank 37. A ring-shaped packing (not shown) is fitted into each flow path connection portions 38 and liquid-tightness with the flow path member 24 is secured by the packing. Further, in the inside of the sub-tank 37, a driving substrate (not shown) for supplying a driving signal to the pressure generation section is provided. In an opening of a central portion of the back end surface of the sub-tank 37, a connector 49 which electrically connects a flexible cable (one type of a wiring member; not shown) to the driving substrate is disposed.

Figure 21A:
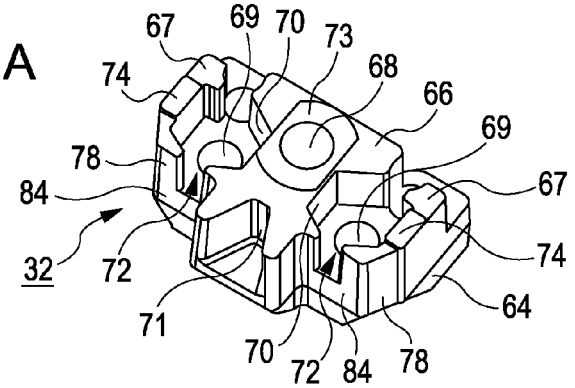
FIGS. 21A to 21E are diagrams describing the configuration of a spacer.
Figure 21B:
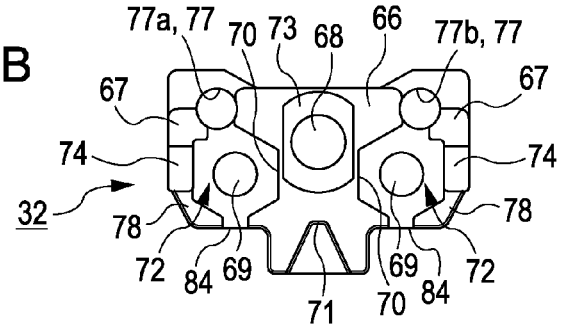
Figure 21C:
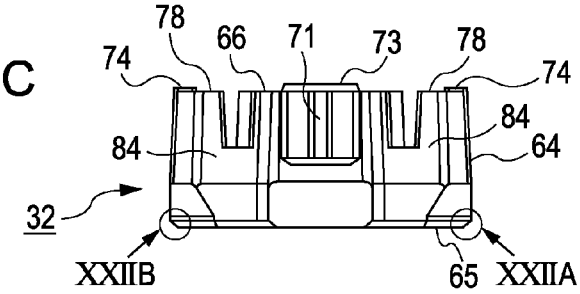
Figure 21D:
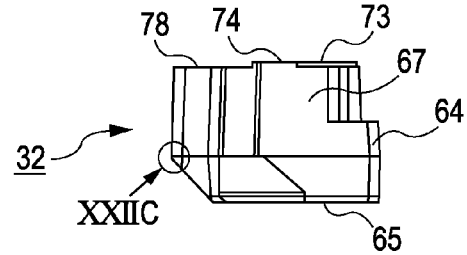
Figure 21E:
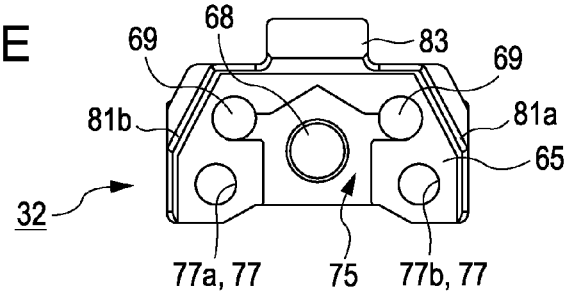
Figure 22A:
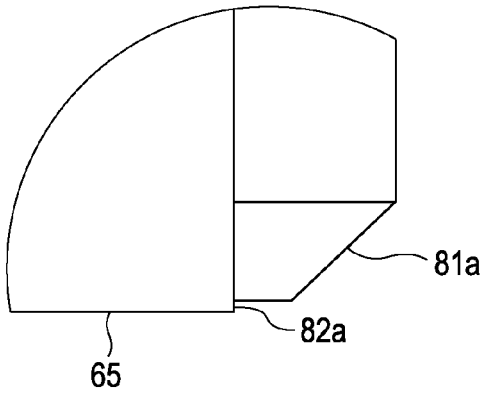
FIGS. 22A to 22C are enlarged views of areas XXIIA, XXIIB, and XXIIC in FIGS. 21C and 21D.
Figure 22B:
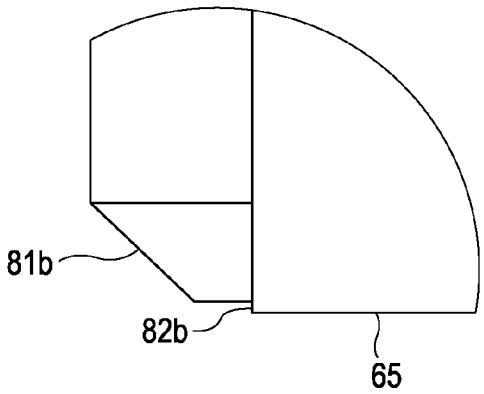
Figure 22C:
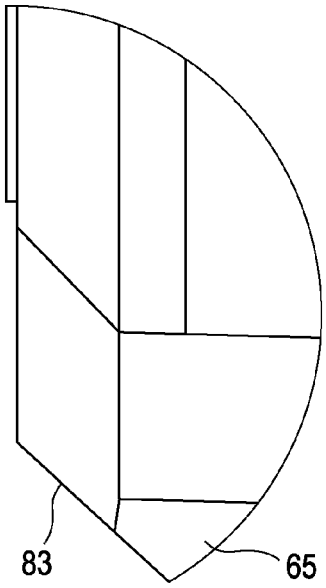
Figure 23:
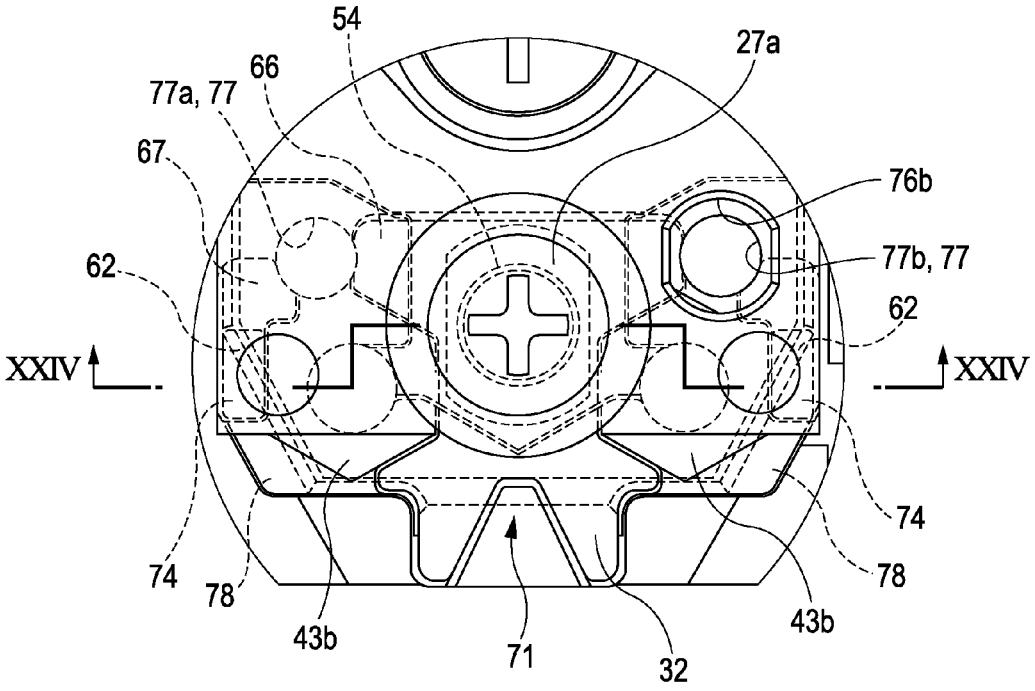
FIG. 23 is an enlarged view of a spacer fixing portion in a flange portion.
Figure 24:
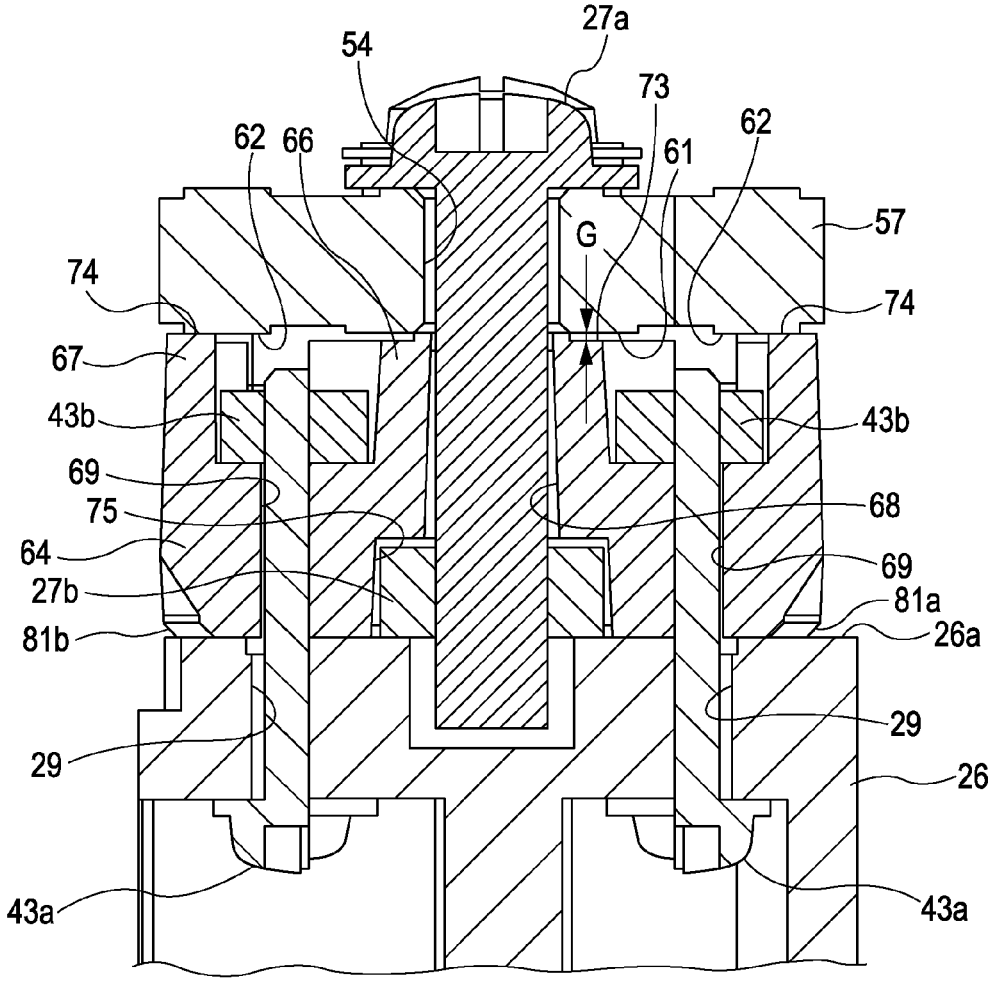
FIG. 24 is a cross-sectional view taken along line XXIV-XXIV in FIG. 23.

FIGS. 21A to 21E are diagrams describing the configuration of the spacer 32 (one type of the intermediary member), wherein FIG. 21A is a perspective view, FIG. 21B is a top view, FIG. 21C is a front view, FIG. 21D is a right side view, and FIG. 21E is a bottom view. FIGS. 22A to 22C are enlarged views of areas XXIIA, XXIIB, and XXIIC in FIGS. 21C and 21D. Further, FIG. 23 is an enlarged view of the mounting position of the spacer 32 in the flange portion 57 (an enlarged view of an area XXIII in FIG. 10), and FIG. 24 is a cross-sectional view taken along line XXIV-XXIV in FIG. 23.

The space 32 in this embodiment is a member made of a synthetic resin, that is, a member which is formed by resin molding, and a total of two spacers, one for each of the spacer fixing surfaces 63 (the surfaces on the sub-tank 37 side) of the flange portions 57 on both sides are mounted with respect to a single recording head 18. The spacers 32 are made to have the same shape. Then, the recording head 18 is mounted on the base portion 26*a* of the sub-carriage 26 through the intermediary of the spacers 32. Therefore, the space 32 is a member which defines a position in a height direction (a direction perpendicular to the nozzle formation surface) with respect to the base portion 26*a* of the sub-carriage 26. Therefore, with regard to a dimension from a base surface 65 of the spacer 32 to the surface (a leading end surface) of a reference plane protrusion portion 74 which will be described later, higher precision is required.

The spacer 32 has a spacer main body portion 64 having the base surface 65 which is disposed on the base portion 26*a* of the sub-carriage 26, back end-side protrusion portions 67, the reference plane protrusion portions 74, and leading end-side protrusion portions 78. Here, the back end-side protrusion portions 67, the reference plane protrusion portions 74, and the leading end-side protrusion portions 78 are convex portions which rise from the spacer main body portion 64 to direct toward the flange portion 57 from the sub-carriage 26 side and are respectively formed toward the leading end portion of the flange portion 57 in relation to the direction of the nozzle row 56 at both end portions in a width direction perpendicular to the nozzle row 56 (refer to FIG. 12).

Further, the reference plane protrusion portion 74 has a surface which becomes a reference plane that defines the height position of the recording head 18 with respect to the sub-carriage 26 (refer to FIG. 24) by its contact with the flange portion 57. The back end-side protrusion portion 67 is integrally formed contiguous to the reference plane protrusion portion 74 at the base end portion side in relation to the direction of the nozzle row 56 such that the height position of the surface thereof becomes equal to or less than the reference plane of the reference plane protrusion portion 74. The leading end-side protrusion portion 78 is integrally formed contiguous to the reference plane protrusion portion 74 at the leading end portion side in relation to the direction of the nozzle row 56 such that the height position of the surface thereof becomes equal to or less than the reference plane of the reference plane protrusion portion 74. Further, a configuration is made such that tips of ejector pins at the time of injection molding of the spacer 32 come into contact with the back end-side protrusion portions 67 and the leading end-side protrusion portions 78. As a result, according to this embodiment, since it is possible to bring the ejector pins into contact with the back end-side protrusion portions 67 and the leading end-side protrusion portions 78 at the time of injection molding of the spacer 32, it is possible to remove gas from the ejector pin portions.

At the spacer 32, chamfered portions (hereinafter also referred to as C-planes) 81*a*, 81*b*, and 83 for injection of an adhesive around the base surface 65, and stepped portions 82*a* and 82*b* continuing to the C-planes 81*a* and 81*b* are formed, as clearly shown in FIGS. 22A to 22C.

Further, the spacer 32 in this embodiment has a central protuberant portion 66 formed at a central portion in the width direction (equivalent to the flange width direction in a state where it is mounted on the flange portion 57) of the spacer main body portion 64, and the back end-side protrusion portions 67 are formed being spaced-apart from each other on both sides in the width direction with respect to the central protuberant portion 66. In a plan view, the dimension in the width direction of the spacer 32 approximately corresponds with the dimension in the width direction of the flange portion 57. Further, in a state where the spacer 32 is correctly mounted on the flange portion 57, a portion (described later) of the central protuberant portion 66 slightly protrudes laterally further than a protruding end surface of the flange portion 57.

The central protuberant portion 66 protrudes from the spacer main body 64 in a direction of coming to the flange portion 57 side in the mounted state. Cutouts each following the shape of each side of a head fixing nut 43*b* (refer to FIG. 23 or the like) in a plan view are provided in the side surfaces on both sides in the width direction of the central protuberant portion 66. Each of the cutouts is a cutout for head fixing nut 70 which regulates the position (that is, rotation at the time of fastening) in a planar direction of the head fixing nut 43*b* along with the inner wall surfaces of the back end-side protrusion portion 67, the reference plane protrusion portion 74, and the leading end-side protrusion portion 78. That is, a head fixing nut accommodating portion 72 that is a concave portion which accommodates the head fixing nut 43*b* is defined by the spacer main body 64, the cutout for head fixing nut 70, the back end-side protrusion portion 67, the reference plane protrusion portion 74, and the leading end-side protrusion portion 78. Then, in a step before the spacer 32 is fixed to the flange portion 57, the head fixing nuts 43*b* are respectively fitted into the respective head fixing nut accommodating portions 72. Here, a cutout portion 84 toward the base surface 65 side from the flange portion 57 side is formed on the leading end side of each leading end-side protrusion portion 78.

The portion on one side (the opposite side to the sub-carriage 37 side in a state where the spacer is mounted on the flange portion 57) in a depth direction of the central protuberant portion 66 protrudes laterally from the spacer main body 64. In the protruding portion, a cutout for jig 71 having an approximately triangular shape in a plan view in which a width gradually narrows from one side in the depth direction toward the other side is formed. When the recording head 18 is positioned on the head mounting portion of the sub-carriage 26, a jig for holding the head is fitted into the cutout for jig 71.

In the central portion in the width direction of the central protuberant portion 66, the insertion hole for head 68 is opened corresponding to the spacer mounting hole 54 of the flange portion 57 of the recording head 18. The insertion hole for head 68 is a through-hole having a circular hole shape in a plan view, as shown in FIG. 21B. The inner diameter of the insertion hole for head 68 is set to be slightly larger than the outer diameter of the shaft portion of the spacer fixing bolt 27*a* and corresponds with the inner diameter of the spacer mounting hole 54. An insertion hole peripheral portion 73 of the insertion hole for head 68 protrudes further to the flange portion 57 side in the mounted state than the protruding end surface of the central protuberant portion 66. The insertion hole peripheral portion 73 is a bank-shaped protrusion surrounding the opening of the insertion hole for head 68 in a plan view and is provided at a position corresponding to the opening peripheral portion 61 of the flange portion 57.

In the head fixing nut accommodating portions 72 provided on both sides of the central protuberant portion 66, insertion holes for sub-carriage 69 are respectively opened corresponding to the locking holes 29 provided at the base portion 26*a* of the sub-carriage 26. These insertion holes for sub-carriage 69 are through-holes having a circular hole shape in a plan view, as shown in FIG. 21B, and the inner diameter thereof is set to be slightly larger than the outer diameter of a shaft portion of a head fixing bolt 43*a*. Accordingly, a configuration is made such that the shaft portion of the head fixing bolt 43*a* can be smoothly inserted into the insertion hole for sub-carriage 69 and it is difficult for rattling to occur between the two. In this manner, one insertion hole for head 68 and two insertion holes for sub-carriage 69 are provided at a single spacer 32. That is, the place of fastening the spacer 32 to the sub-carriage 26 by the head fixing bolt 43*a* and the head fixing nut 43*b* is further on the outside in the width direction than the place of fastening the spacer 32 to the flange portion 57.

The back end-side protrusion portions 67 which are respectively provided at both end portions in the width direction of the spacer 32 are walls protruding from the spacer main body 64 in a direction of coming to the flange portion 57 side in the mounted state and are formed successively to both side surfaces in the width direction of the spacer main body 64. The protruding end surfaces of the back end-side protrusion portions 67 are aligned on the same plane with the protruding end surface of the central protuberant portion 66. Further, on the protruding end surface of each back end-side protrusion portion 67, the reference plane protrusion portion 74 is provided to protrude from the end surface in a direction of coming to the flange portion 57 side in the mounted state. The reference plane protrusion portion 74 is provided at a position where it can come into contact with the convex contact portion 62 in a state where the spacer 32 is correctly mounted on the flange portion 57 (a state where the spacer 32 is fastened by the spacer fixing bolt 27*a* and the spacer fixing nut 27*b*). The surface of the reference plane protrusion portion 74 functions as a reference plane in the invention.

In a central portion in the width direction on the base surface 65 side of the spacer 32, a spacer fixing nut accommodating portion 75 is formed. The spacer fixing nut accommodating portion 75 is a depression following the shape of a portion of the spacer fixing nut 27*b* in a plan view and is depressed halfway in the thickness direction of the spacer 32 from the base surface 65. In a state where the spacer fixing nut 27*b* is fitted into the spacer fixing nut accommodating portion 75 and seated on a bottom portion of the depression, the position in a planar direction of the spacer fixing nut 27*b* is regulated by the inner wall surface of the spacer fixing nut accommodating portion 75. That is, the rotation of the spacer fixing nut 27*b* at the time of fastening with the spacer fixing bolt 27*a* is prevented. Further, in the bottom portion of the depression of the spacer fixing nut accommodating portion 75, the insertion hole for head 68 is opened. Further, at positions, each of which is between the central protuberant portion 66 and the back end-side protrusion portion 67 in the spacer 32 and deviates from the head fixing nut accommodating portions 72, positioning holes 77 are opened at a total of two places in a state of penetrating the spacer 32 in the thickness direction. The positioning holes 77*a* and 77*b* are formed at positions which are bilaterally symmetrical with respect to the central portion in the width direction of the spacer 32.

The positioning holes 77 in this embodiment are through-holes having a circular shape in a plan view. The positioning hole 77*a* (the left side in FIG. 21B) on one side of a pair of positioning holes 77 is provided at a position corresponding to the circular hole 76*a* in a state where the spacer 32 is mounted on the flange portion 57*a*, in the spacer 32. On the other hand, the positioning hole 77*b* (the right side in FIG. 21B) on the other side is provided at a position corresponding to the long hole 76*b* in a state where the spacer 32 is mounted on the flange portion 57*b*, in the spacer 32. That is, in each spacer 32, the positioning hole 77*a* corresponding to the circular hole 76*a* of the flange portion 57*a* and the positioning hole 77*b* corresponding to the long hole 76*b* of the flange portion 57*b* are opened.

Figure 25:
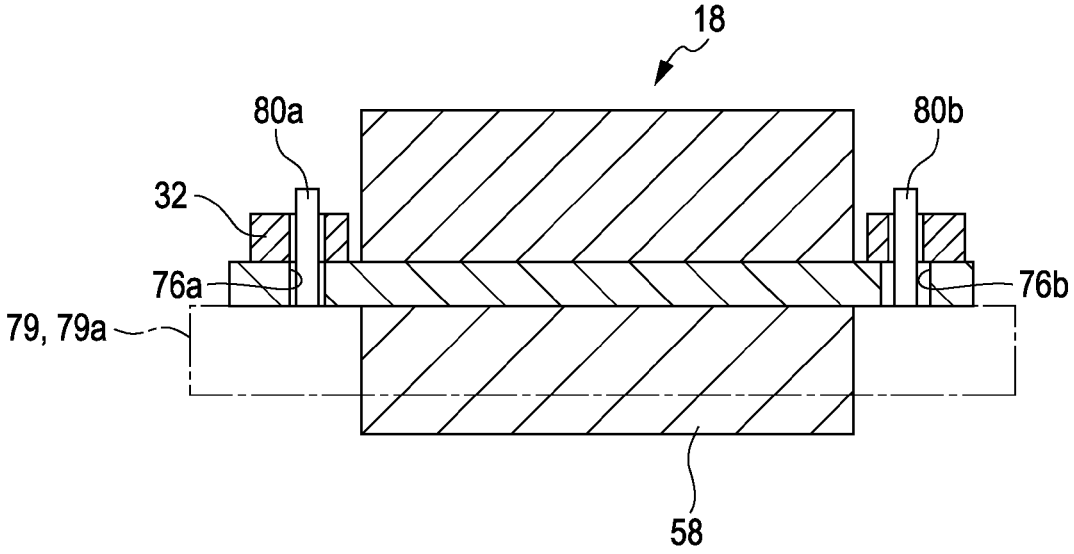
FIG. 25 is a schematic view describing a positioning process of the spacer with respect to the recording head.

Next, a process of positioning the spacer 32 on each of the flange portions 57*a* and 57*b* on both sides of the recording head 18 will be described with reference to the schematic view of FIG. 25. In the spacer positioning process, first, the recording head 18 is set on the positioning jig 79. At the positioning jig 79, a pair of positioning pins 80*a* and 80*b* is provided in an erect manner, and by inserting the positioning pin 80*a* on one side into the circular hole 76*a* of the flange portion 57*a* and also inserting the positioning pin 80*b* on the other side into the long hole 76*b* of the flange portion 57*b*, the position in a planar direction (a plane direction parallel to the nozzle formation surface) of the recording head 18 with respect to the positioning jig 79 is defined. Here, since the inner diameter in a positioning hole arrangement direction of the long hole 76*b* is set to be larger than the outer diameter of the positioning pin 80*b*, an error between the distance between the circular hole 76*a* and the long hole 76*b* and the distance between the positioning pins 80*a* and 80*b* is allowed within the range of a gap that is formed between the positioning pin 80*b* and the long hole 76*b*.

If the recording head 18 has been set on the positioning jig 79, the spacers 32 are respectively disposed on the flange portions 57*a* and 57*b* on both sides of the recording head 18. The respective spacers 32 are respectively disposed on the flange portions 57 in symmetrical positions (that is, 180° rotated positions) centered on the head main body, in a state where the insertion hole peripheral portions 73 of the spacers 32 face the opening peripheral portions 61 of the flange portions 57 and also the cutouts for jig 71 face the opposite sides to each other (the outside). At this time, the positioning pin 80*a* on one side which protrudes from the circular hole 76*a* of the flange portion 57*a* is inserted into the positioning hole 77*a*, whereby the space 32 which is disposed on the flange portion 57*a* on one side is positioned with respect to the flange portion 57*a*. In addition, the rotation of the spacer 32 around the positioning hole 77*a* is restricted by another jig (not shown). Similarly, the positioning pin 80*b* on the other side which protrudes from the long hole 76*b* of the flange portion 57*b* is inserted into the positioning hole 77*b*, whereby the space 32 which is disposed on the flange portion 57*b* on the other side is positioned with respect to the flange portion 57*b*. Then, each spacer 32 is fastened to the flange portion 57 by the spacer fixing bolt 27*a* and the spacer fixing nut 27*b* in the positioned state. In this way, the spacers 32 are positioned and fixed with respect to the respective flange portions 57*a* and 57*b* in directions symmetrical to each other.

Here, in a state after the spacer 32 is disposed on the flange portion 57 and before fastening by the spacer fixing bolt 27*a* and the spacer fixing nut 27*b* is performed, the convex contact portions 62 and the reference plane protrusion portions 74 come into contact with each other at both end portions away from the fastening place as far as possible in the flange width direction and on the other hand, a gap G (refer to FIG. 24) is formed in the fastening place (fastening planned place) of the spacer 32 and the flange portion 57, that is, between the opening peripheral portion 61 of the spacer mounting hole 54 and the insertion hole peripheral portion 73 of the insertion hole for head 68. Accordingly, in a state after the spacer 32 is fastened to the flange portion 57 by the spacer fixing bolt 27*a* and the spacer fixing nut 27*b*, the convex contact portions 62 and the reference plane protrusion portions 74 come into contact with each other in preference to other portions on the outer sides in the flange width direction than the fastening place of the spacer 32 and the flange portion 57 and the fastening place of the spacer 32 and the sub-carriage 26. By the contact of the convex contact portions 62 with the reference plane protrusion portions 74, the position in the height direction and the position of the spacer 32 with respect to the flange portion 57 are regulated. By adopting such a configuration, occurrence of an inclination in a direction perpendicular to an imaginary line connecting the fastening places of the flange portions 57 on both sides, in this embodiment, the short direction of the recording head 18, between the recording head 18 and the spacer 32 is suppressed. Therefore, even in a state where the recording head 18 is mounted on the sub-carriage 26 with the spacers 32 interposed therebetween, an inclination in the short direction of the recording head 18 with respect to the sub-carriage 26 is suppressed.

If the spacers 32 have been respectively fixed to the flange portions 57 on both sides of the recording head 18, next, the positioning of the recording head 18 with respect to the head mounting portion of the sub-carriage 26 is performed. In this positioning process, the position of the recording head 18 on the base portion 26*a* is adjusted in such a manner that a predetermined plurality (at least two places) of specific nozzles 51 of the nozzle formation surface 53 are positioned at prescribed positions, for example, while observing the nozzle formation surface 53 of the recording head 18 set on the head mounting portion of the base portion 26*a* of the sub-carriage 26 by using an imaging section such as a CCD camera. If the recording head 18 that is a mounting target has been positioned, subsequently, the spacers 32 mounted on the recording head 18 are temporarily fixed to the base portion 26*a* by an adhesive. The temporary fixation is performed by filling the C-planes 81*a* and 81*b* and the stepped portions 82*a* and 82*b* formed around the base surface 65 with an adhesive. Further, as the adhesive which is used in the temporary fixation, a so-called instant adhesive with cyanoacrylate as a main component is suitable. However, provided that it is an adhesive exhibiting the rigidity of an extent that the recording head 18 is fixed to the sub-carriage 26 without rattling in a fully cured state, any adhesive can be used. For example, it is also possible to adopt an ultraviolet cure adhesive. In this case, it is preferable to manufacture the spacer 32 or the sub-carriage 26 by a material having translucency. Then, after the adhesive is cured, the spacer 32 and the base portion 26*a* are fastened to each other by the head fixing bolts 43*a* and the head fixing nuts 43*b*, so that the main fixation of the recording head 18*a* to the prescribed position of the base portion 26*a* is performed.

Each recording head 18 is mounted with respect to the sub-carriage 26 in such a procedure. Thereafter, the flow path member 24 is fixed to the sub-carriage 26. As described above, the flow path member 24 is fixed to the sub-carriage 26 by the flow path locking screws 45. At this time, connection flow paths 40 of the flow path member 24 are respectively inserted into the flow path connection portions 38 of the sub-tank 37 of each recording head 18 and connected thereto in a liquid-tight state. In addition, the flow path member 24 may also be fixed to the sub-carriage 26 in a step before each recording head 18 is mounted on the sub-carriage 26.

The head unit 17 is completed through the above processes. The head unit 17 is accommodated in the inside of the carriage main body 12 in a state where the nozzle formation surface 53 of each recording head 18 is exposed from the bottom opening 19 of the bottom plate portion 12*a* of the carriage main body 12, as described above, and screw-fastened and fixed by the head unit fixing screws 22 after the position or the position such as an inclination of the head unit 17 with respect to the carriage main body 12 is adjusted.

As described above, in the spacer 32 of the head unit 17 of this embodiment, since not only the back end-side protrusion portions 67, but also the leading end-side protrusion portions 78 are integrally formed contiguous to the reference plane protrusion portions 74 to continue to the reference plane protrusion portions 74, even in a case where the spacer 32 is molded using resin, resin sagging caused by the lack of filling of resin in the reference plane protrusion portions 74 does not occur in the leading end portions of the reference planes of the reference plane protrusion portions. That is, it is possible to secure a reference plane having a necessary and sufficient area, which is a planar surface maintained at a high-precision height position in the reference plane protrusion portion 74. As a result, it is possible to fix the recording head 18 to the sub-carriage 26 in a state where the height position from the sub-carriage 26 of the nozzle formation surface 53 is positioned with high precision through the reference plane having a necessary and sufficient area.

Further, in this embodiment, since an inner space surrounded by the back end-side protrusion portions 67, the reference plane protrusion portions 74, and the leading end-side protrusion portions 78 is made to be a concave portion which receives the nut 43*b*, the leading end-side protrusion portions 78 can also contribute to improvement in the rigidity of the concave portion, so that the rigidity of the concave portion against a clamping force at the time of nut fastening is improved by a corresponding amount. Further, since the C-planes 81*a* and 81*b* for injection of an adhesive are provided around the base surface 65 of the spacer 32, when the spacer 32 is temporarily fixed to the sub-carriage 26 by an adhesive, the adhesive is filled around the base surface 65 through the C-planes 81*a* and 81*b*, whereby such adhesive filling work can be performed easily and accurately. Further, at the time of such adhesive filling work, a state where an obstacle interfering with an adhering tool is not present midway can be created by using the cutout portion 84, so that it is possible to accurately and easily perform the filling work.

Further, in the above embodiment, since a configuration is adopted in which the flange portions 57 of the recording head 18, to which the spacers 32 is fixed, are respectively provided both sides with the head case 52 interposed therebetween, the spacer mounting holes 54 for mounting the spacers 32 are respectively provided at the central portions in the width direction perpendicular to the nozzle row 56 of the recording head 18 in the flange portions 57*a* and 57*b*, the circular hole 76*a* and the long hole 76*b* which become the references of positioning with respect to the spacers 32 are respectively provided at positions which deviate from the central line ○ in the width direction, the positioning holes 77*a* and 77*b* which become the references of positioning with respect to the flange portions 57*a* and 57*b* are respectively provided at positions corresponding to the circular hole 76*a* and the long hole 76*b* of the flange portions 57*a* and 57*b* in each spacer 32, and the spacers 32 are respectively fixed in directions symmetrical to each other to the flange portions 57*a* and 57*b* on both sides in a state where the positioning holes 77*a* and 77*b* are aligned in position with the circular hole 76*a* and the long hole 76*b*, the commonalization of components and the commonalization of the shape and dimensional management of the spacers 32 which are fixed to the flange portions 57*a* and 57*b* on both sides of the recording head 18 become possible. In this way, variations in the shapes and the dimensions of the spacers 32 are reduced. As a result, it is possible to suppress an inclination of the recording head 18 with respect to the sub-carriage 26, which is caused by variations in the shapes and the dimensions of the spacers 32, as much as possible. In particular, since in the respective spacers 32, the positioning holes 77*a* and 77*b* are respectively provided at a total of two places corresponding to the circular hole 76*a* and the long hole 76*b* of the flange portions 57*a* and 57*b*, even in a configuration in which the circular hole 76*a* and the long hole 76*b* are inevitably provided at positions which deviate from the central lines in the width direction in the flange portions 57 from the relationship that the spacer mounting holes 54 are provided at the central portions of the flange portions 57 after the spacer 32 is made as small as possible, the commonalization of the respective spacers 32 becomes possible. In this way, variations in the shape and the dimension of the respective spacers 32 are reduced.

Further, since the width in a direction perpendicular to the nozzle row 56 in the spacer 32 is formed narrower than the width in a direction perpendicular to the nozzle row in the recording head 18, in a case where a plurality of recording heads 18 are disposed side by side, interference of an intermediary member between adjacent liquid ejecting heads is prevented. Accordingly, it is possible to narrow the pitch between the recording heads 18 in the sub-carriage 26. As a result, a reduction in the size of the head unit 17 becomes possible.

In addition, as at least the spacers 32 which are fixed to the flange portions 57 on both sides of the same recoding head 18, it is preferable to use spacers made by the same metal mold. In this way, it is possible to make the dimensions and the shapes of the spacers 32 which are fixed to the flange portions 57 on both sides of the same recoding head 18 as uniform as possible. In this way, it is possible to more reliably prevent an inclination of the recording head 18 with respect to the sub-carriage 26.

Further, it is possible to adopt a configuration in which a lapping treatment which performs planarization by polishing is simultaneously carried out on the leading end surfaces of the reference plane protrusion portions 74 of each of the spacers 32 which are fixed to the flange portions 57 on both sides of the same recoding head 18. By configuring it in this manner, it is possible to more reliably make the dimensions and the shapes of the spacers 32 uniform. In particular, since it is possible to make the dimension in the height direction from the base surface 65 of the spacer 32 to the leading end surface of the reference plane protrusion portion 74 uniform in the spacers 32 with higher precision, it is possible to more reliably prevent an inclination of the recording head 18 with respect to the sub-carriage 26.

In addition, the invention is not limited to each embodiment described above and various modifications can be made on the basis of the statements of the claims.

For example, in each embodiment described above, a configuration in which ejection of ink is performed while reciprocating the recording head 18 with respect to the recording medium has been exemplified. However, the invention is not limited thereto. For example, a configuration can also be adopted in which ejection of ink is performed while moving the recording medium with respect to the recording head 18 in a state where the position of the recording head 18 is fixed.

Further, in the above, the ink jet type printer 1 that is one type of a liquid ejecting apparatus has been taken and described as an example. However, the invention can also be applied to other liquid ejecting apparatuses each adopting a configuration in which a liquid ejecting head is fixed to a head fixing member in a state where an intermediary member is interposed therebetween. For example, the invention can also be applied to a display manufacturing apparatus which manufactures a color filter of a liquid crystal display or the like, an electrode manufacturing apparatus which forms an electrode of an organic EL (Electro Luminescence) display, a FED (a surface-emitting display), or the like, a chip manufacturing apparatus which manufactures a biochip (a biochemical element), and a micropipette which supplies a very small amount of sample solution in a precise amount.

What is claimed is:

1. A liquid ejecting head unit comprising:

a liquid ejecting head having a nozzle formation surface in which a nozzle row that includes a plurality of nozzles ejecting liquid which are provided in a row is formed; and a head fixing member to which the liquid ejecting head is fixed in a state where intermediary members are interposed therebetween, wherein the liquid ejecting head has intermediary member fixing portions to which the intermediary members are fixed and which are respectively provided on both sides with a head main body interposed therebetween, each of the intermediary members has an intermediary member main body portion having a base surface which comes into contact with the head fixing member, and back end-side protrusion portions, reference plane protrusion portions, and leading end-side protrusion portions, which are convex portions that rise from the intermediary member main body portion to direct toward the intermediary member fixing portion side from the head fixing member side and which are respectively formed toward a leading end portion of each intermediary member fixing portion in relation to a direction of the nozzle row, at both end portions in a width direction perpendicular to the nozzle row, each of the reference plane protrusion portions has a surface that becomes a reference plane which comes into contact with the intermediary member fixing portion, thereby defining the height position of the liquid ejecting head with respect to the head fixing member, each of the back end-side protrusion portions is integrally formed contiguous to each of the reference plane protrusion portions on the base end portion side in relation to the direction of the nozzle row such that the height position of the surface thereof becomes equal to or less than the reference plane, and each of the leading end-side protrusion portions is integrally formed contiguous to each of the reference plane protrusion portions on the leading end portion side in relation to the direction of the nozzle row such that the height position of the surface thereof becomes equal to or less than the reference plane.

2. The liquid ejecting head unit according to claim 1, wherein an inner space surrounded by the back end-side protrusion portions, the reference plane protrusion portions, and the leading end-side protrusion portions is made to be a concave portion which receives a nut.

3. A liquid ejecting apparatus comprising: the liquid ejecting head unit according to claim 2.

4. The liquid ejecting head unit according to claim 1, wherein chamfered portions for injection of an adhesive are provided around the base surface of the intermediary member and cutout portions toward the chamfered portion side from the intermediary member fixing portion side are formed in the leading end sides of the leading end-side protrusion portions.

5. A liquid ejecting apparatus comprising: the liquid ejecting head unit according to claim 4.

6. The liquid ejecting head unit according to claim 1, wherein tips of ejector pins at the time of injection molding come into contact with the surfaces of the leading end-side protrusion portions.

7. A liquid ejecting apparatus comprising: the liquid ejecting head unit according to claim 6.

8. The liquid ejecting head unit according to claim 1, wherein in each of the intermediary member fixing portions, an intermediary member mounting hole for mounting the intermediary member is provided at a central portion in the width direction and a head-side positioning hole which becomes the reference of positioning with respect to the intermediary member is provided at a position that deviates from the central line in the width direction, in each of the intermediary members, an intermediary member-side positioning hole which becomes the reference of positioning with respect to the intermediary member fixing portion is provided at a position corresponding to the head-side positioning hole of each of the intermediary member fixing portions, and the intermediary members are fixed to the intermediary member fixing portions on both sides in directions symmetrical to each other in a state where positioning is performed by aligning the intermediary member-side positioning holes with the head-side positioning holes.

9. A liquid ejecting apparatus comprising: the liquid ejecting head unit according to claim 8.

10. The liquid ejecting head unit according to claim 1, wherein the width in a direction perpendicular to the nozzle row in the intermediary member is formed narrower than the width in a direction perpendicular to the nozzle row in the liquid ejecting head.

11. A liquid ejecting apparatus comprising: the liquid ejecting head unit according to claim 10.

12. The liquid ejecting head unit according to claim 1, wherein the respective head-side positioning holes of the intermediary member fixing portions on both sides of the liquid ejecting head are provided at positions that respectively deviate by the same distance from the central line to one side in a direction perpendicular to the nozzle row.

13. A liquid ejecting apparatus comprising: the liquid ejecting head unit according to claim 12.

14. A liquid ejecting apparatus comprising: the liquid ejecting head unit according to claim 1.

* * * * *